US005267440A

United States Patent [19]

Nakamura et al.

[11] Patent Number: 5,267,440

[45] Date of Patent: Dec. 7, 1993

[54] HYDRAULIC CONTROL SYSTEM FOR CONSTRUCTION MACHINE

[75] Inventors: Kazunori Nakamura, Ibaraki; Yusuke Kajita, Tsuchiura; Toichi Hirata, Ushiku; Genroku Sugiyama; Hiroshi Onoue, both of Ibaraki; Hideaki Tanaka; Osamu Tomikawa, both of Tsuchiura; Masakazu Haga, Ibaraki; Hiroshi Watanabe, Ushiku, all of Japan

[73] Assignee: Hitachi Construction Machinery Co., Ltd., Tokyo, Japan

[21] Appl. No.: 854,668

[22] PCT Filed: Sep. 11, 1991

[86] PCT No.: PCT/JP91/01204

§ 371 Date: May 4, 1992

§ 102(e) Date: May 4, 1992

[87] PCT Pub. No.: WO92/04505

PCT Pub. Date: Mar. 19, 1992

[30] Foreign Application Priority Data

Sep. 11, 1990 [JP] Japan ..... 2-238951

[51] Int. Cl.[5] ..... F16D 31/02; F15B 11/08; F15B 13/00

[52] U.S. Cl. ..... 60/426; 60/427; 60/452; 60/459; 60/484; 91/448; 91/461; 91/517; 91/518; 91/529; 91/531

[58] Field of Search ..... 60/420, 426, 427, 444, 60/452, 459, 484; 91/448, 461, 517, 518, 529, 531

[56] References Cited

U.S. PATENT DOCUMENTS

| | | | |
|---|---|---|---|
| 4,967,557 | 11/1990 | Izumi et al. | 60/426 X |
| 5,048,293 | 9/1991 | Aoyagi | 60/427 X |
| 5,056,312 | 10/1991 | Hirata et al. . | |
| 5,079,919 | 1/1992 | Nakamura et al. | 60/426 |

FOREIGN PATENT DOCUMENTS

| | | |
|---|---|---|
| 379595 | 8/1990 | European Pat. Off. . |
| 63-43006 | 2/1988 | Japan . |
| 64-15568 | 1/1989 | Japan . |
| 2-76904 | 3/1990 | Japan . |
| 2-164941 | 6/1990 | Japan . |
| 2-178427 | 7/1990 | Japan . |
| 2-178428 | 7/1990 | Japan . |
| 2-186105 | 7/1990 | Japan . |
| 2-1733468 | 7/1990 | Japan . |
| 2-212601 | 8/1990 | Japan . |
| 88/03285 | 5/1988 | PCT Int'l Appl. . |

OTHER PUBLICATIONS

Patent Abstracts of Japan 59047504 Mar. 17, 1984.

*Primary Examiner*—Edward K. Look
*Assistant Examiner*—John Ryznic
*Attorney, Agent, or Firm*—Fay, Sharpe, Beall, Fagan, Minnich & McKee

[57] ABSTRACT

In a controller (229) of a hydraulic control system for construction machines, a valve control signal calculating function (301) works such that when an operation pattern signal (A-I) for actuators (201, 202 . . . ) is outputted, it selects corresponding one of plural output patterns for an auxiliary valve control pressure stored, as a function of a differential pressure signal between a pump delivery pressure and a maximum load pressure, in relation to the operation pattern signals, followed by calculating an auxiliary valve control pressure (Pc) dependent upon the differential pressure signal based on the selected output pattern, and also selects corresponding one of plural sets of rates of change (K . . . , K . . . ) for the auxiliary valve control pressure stored in relation to the operation pattern signals, followed by combining the calculated auxiliary valve control amount with the selected set of speed changes to calculate each of valve control signals (S21–S26).

14 Claims, 22 Drawing Sheets

FIG. 6

| | OPERATION PATTERN | MEMORY AREA NO. | PUMP CONTROL GAIN | |
|---|---|---|---|---|
| | | | LSU | LSD |
| A (SWING RIGHT & LEFT) | ARM PULL+BOOM-UP (LEVEL PULLING) | | | |
| B (BOOM-UP) | SWING + ARM + ETC. | | | |
| C (BOOM-DOWN) | ONLY BOOM-UP | | LSU | |
| D (ARM PULL) | ONLY TRAVEL | | | |
| E (ARM PUSH) | TRAVEL + ETC. (COMBINED TRAVEL) | | | LSD |
| F (BUCKET PULL) | ONLY SWING | | | |
| G (BUCKET PUSH) | - - - - | | | |
| H (TRAVEL RIGHT) | OTHERS | | | |
| I (TRAVEL LEFT) | | | | |
| - - - - | | | | |

FIG. 7

| | | | TARGET DIFFERENTIAL PRESSRE |
|---|---|---|---|
| | OPERATION PATTERN | MEMORY AREA NO. | $\Delta P_{LSr}$ |
| A (SWING RIGHT & LEFT) → | ARM PULL+ BOOM -UP (LEVEL PULLING) | | |
| B (BOOM-UP) → | | | |
| C (BOOM-DOWN) → | SWING + ARM + ETC. | | |
| D (ARM PULL) → | ONLY BOOM-UP | | |
| E (ARM PUSH) → | | | |
| F (BUCKET PULL) → | ONLY TRAVEL | | |
| G (BUCKET PUSH) → | | | |
| H (TRAVEL RIGHT) → | TRAVEL + ETC. (COMBINED TRAVEL) | | |
| I (TRAVEL LEFT) → | ONLY SWING | | |
| | ⋮ | | |
| | OTHERS | | |

TAGET DIFFERENTIAL PRESSRE → $\Delta P_{LSr}$

FIG.8

| | OPERATION PATTERN | MEMORY AREA NO. | BOOM | | | | ARM | | | | BUCKET | | | | SWING | | | | TRAVEL | | | |
|---|---|---|---|---|---|---|---|---|---|---|---|---|---|---|---|---|---|---|---|---|---|---|
| | | | G BM | O BM | MA BM | MI BM | G AM | O AM | MA AM | MI AM | G BK | O BK | MA BK | MI BK | G SW | O SW | MA SW | MI SW | G TR | O TR | MA TR | MI TR |
| A (SWING RIGHT & LEFT) | ARM PULL + BOOM-UP (LEVEL PULLING) | | | | | | | | | | | | | | | | | | | | | |
| B (BOOM-UP) | | | | | | | | | | | | | | | | | | | | | | |
| C (BOOM-DOWN) | SWING + ARM + ETC. | | | | | | | | | | | | | | | | | | | | | |
| D (ARM PULL) | | | | | | | | | | | | | | | | | | | | | | |
| E (ARM PUSH) | ONLY BOOM-UP | | | | | | | | | | | | | | | | | | | | | |
| F (BUCKET PULL) | | | | | | | | | | | | | | | | | | | | | | |
| G (BUCKET PUSH) | ONLY TRAVEL | | | | | | | | | | | | | | | | | | | | | |
| H (TRAVEL RIGHT) | TRAVEL + ETC. (COMBINED TRAVEL) | | | | | | | | | | | | | | | | | | | | | |
| I (TRAVEL LEFT) | | | | | | | | | | | | | | | | | | | | | | |
| | ONLY SWING | | | | | | | | | | | | | | | | | | | | | |
| | ⋮ | | | | | | | | | | | | | | | | | | | | | |
| | OTHERS | | | | | | | | | | | | | | | | | | | | | |

$G_{BM}$
$O_{BM}$
$MA_{BM}$
$MI_{BM}$
$G_{AM}$
$O_{AM}$
$MA_{AM}$
$MI_{AM}$
⋮

FIG.16

| | OPERATION PATTERN | MEMORY AREA NO. | BOOM | | ARM | | BUCKET | | SWING | | TRAVEL | | |
|---|---|---|---|---|---|---|---|---|---|---|---|---|---|
| | | | $K_{BMU}$ | $K_{BMD}$ | $K_{AMU}$ | $K_{AMD}$ | $K_{BKU}$ | $K_{BKD}$ | $K_{SWU}$ | $K_{SWD}$ | $K_{TRU}$ | $K_{TRD}$ | |
| A (SWING RIGHT & LEFT) | ARM PULL + BOOM-UP (LEVEL PULLING) | | | | | | | | | | | | $K_{BMU}$ |
| B (BOOM-UP) | | | | | | | | | | | | | $K_{BMD}$ |
| C (BOOM-DOWN) | SWING + ARM + ETC. | | | | | | | | | | | | $K_{AMU}$ |
| D (ARM PULL) | | | | | | | | | | | | | |
| E (ARM PUSH) | ONLY BOOM-UP | | | | | | | | | | | | $K_{AMD}$ |
| F (BUCKET PULL) | ONLY TRAVEL | | | | | | | | | | | | $K_{BKU}$ |
| G (BUCKET PUSH) | | | | | | | | | | | | | $K_{BKD}$ |
| H (TRAVEL RIGHT) | TRAVEL + ETC. (COMBINED TRAVEL) | | | | | | | | | | | | $K_{SWU}$ |
| I (TRAVEL LEFT) | | | | | | | | | | | | | |
| | ONLY SWING | | | | | | | | | | | | $K_{SWD}$ |
| | ⋮ | | | | | | | | | | | | $K_{TRU}$ |
| | | | | | | | | | | | | | $K_{TRD}$ |
| | OTHERS | | | | | | | | | | | | |

HYDRAULIC CONTROL SYSTEM FOR CONSTRUCTION MACHINE

TECHNICAL FIELD

1. Technical Field

The present invention relates to a hydraulic control system for construction machines, and more particularly to a hydraulic control system for construction machines, such as hydraulic excavators, having a plurality of actuators.

2. Background Art

A hydraulic control system for construction machines, such as hydraulic excavators, comprises a hydraulic pump, a plurality of actuators driven by a hydraulic fluid supplied from the hydraulic pump, and a plurality of valve apparatus for controlling flow rates of the hydraulic fluid respectively supplied to the plurality of actuators from the hydraulic pump. For this type of hydraulic control system, load sensing system is used to control the delivery pressure of the hydraulic pump dependent upon the load pressure. One example of the load sensing system is WO90/00683. This prior art system includes pump control means for controlling the displacement volume of the hydraulic pump so that the delivery pressure of the hydraulic pump is kept higher by a predetermined value than a maximum load pressure among the plurality of actuators. The plurality of valve apparatus each comprise a flow control valve provided with a variable throttle to change its opening dependent upon an operation signal from a control lever unit, and a pressure compensating valve (auxiliary valve) disposed upstream of the variable throttle in series to control a differential pressure across the variable throttle. By controlling the differential pressures across the variable throttles by the associated pressure compensating valves, the hydraulic fluid is positively supplied to the actuator(s) on the low load side as well, thereby enabling driving of the plurality of actuators.

The prior art disclosed in WO90/00683 also comprises a sensor for detecting the differential pressure between the pump delivery pressure and the maximum load pressure (hereinafter referred to as "LS differential pressure") to output a corresponding differential pressure signal, and means for storing an output pattern of the pressure compensating valve control amount corresponding to the differential pressure signal for each actuator and calculating the proper control amount based on the output pattern dependent upon the differential pressure signal from the sensor. The pressure compensating valves are separately controlled in accordance with the calculated control amounts. By so controlling the pressure compensating valve, the supply flow rate is controlled by not only the variable throttle, but also the pressure compensating valve additionally. With this additional flow rate control, during combined operation in which a plurality of actuators are driven simultaneously, it is possible to positively supply the hydraulic fluid to the actuator(s) on the low load side even in a saturation state when the delivery rate of the hydraulic pump becomes insufficient, and also to provide the optimum distribution ratio dependent upon the types of actuators, thereby improving system operability.

Further, in the prior art as illustrated in FIGS. 15 and 16 of WO90/00683, operation signals outputted from control lever units of the swing and boom are electrically detected, and a plurality of output patterns of the pressure compensating valve control amount corresponding to the differential pressure signal are stored in relation to the detected operation signal. When the operation signal is outputted from the control lever unit, the output pattern corresponding to the operation signal is selected and the control amount dependent upon the differential pressure signal is calculated from the selected output pattern. By so calculating the pressure compensating valve control amount in accordance with the operation signal, the additional flow rate control can be effected by the pressure compensating valve dependent upon the operation pattern of the actuator, which further improves the operability.

The prior art disclosed in WO90/00683 has suffered from the following problem.

In the prior art, as mentioned above, the output pattern of the pressure compensating valve control amount corresponding to the differential pressure signal is stored, and the proper operation signal is calculated from the output pattern dependent upon the differential pressure signal from the sensor. Here, the relationship between the differential pressure signal and the control amount is usually set so that as the LS differential pressure decreases, the control force acting on the pressure compensating valve in the closing direction is increased. This is for the purpose of avoiding saturation of the hydraulic pump as stated above. Stated otherwise, when the LS differential pressure becomes small upon the insufficient flow rate of the hydraulic pump, the control force acting on the pressure compensating valve in the closing direction is increased to reduce the opening of the pressure compensating valve, thereby keeping the appropriate distribution ratio. By so setting the relationship between the differential pressure signal and the control amount, however, the calculated control amount is necessarily changed each time the differential pressure signal changes and, correspondingly, the pressure compensating valve is controlled in the closing direction or the opening direction.

Meanwhile, in the load sensing control for construction machines such as hydraulic excavators, the LS differential pressure, i.e., the differential pressure between the pump delivery pressure and the maximum load pressure, is also changed by other causes besides saturation of the hydraulic pump. Such change occurs, by way of example, when the actuator load is fluctuated and when the input amount of the control lever unit is varied. In these cases, the LS differential pressure is changed during a transient period when the pump delivery rate matches the target flow rate and the LS differential pressure matches the target value through the load sensing control. Further, in the case where a plurality of output patterns of the pressure compensating valve control amount are stored in relation to the control signal and the pressure compensating valve control amount is calculated dependent upon the control signal, as illustrated in FIGS. 15 and 16 of WO90/00683, the output pattern is changed with the operation pattern of the actuator switching over from one to another, whereupon the LS differential pressure is also changed transiently.

Thus, in the load sensing control, the LS differential pressure changes for various reasons and the pressure compensating valve is controlled in the closing or opening direction many times. The resultant operation of the pressure compensating valve necessarily changes the flow rate of the hydraulic fluid supplied to the actuator.

In some cases, the operating speed of the actuator may undergo sudden change unexpectedly, thereby affecting the operability. Particularly, when the output patterns are set in relation to a number of control signals in the prior art illustrated in FIGS. 15 and 16 of WO90/00683, the output patterns are changed more frequently when switching-over of operation pattern to another. This increases frequency of change in the LS differential pressure, resulting in a fear of remarkably degrading the operability.

The present invention is concerned with a hydraulic control system adapted to perform load sensing control, and its object is to provide a hydraulic control system for construction machines which can properly control a flow rate of the hydraulic fluid supplied to an actuator when the LS differential pressure is changed.

DISCLOSURE OF THE INVENTION

To achieve the above object, according to the present invention, there is provided a hydraulic control system for a construction machine comprising a hydraulic pump of variable displacement type, a plurality of actuators driven by a hydraulic fluid supplied from said hydraulic pump, a plurality of valve means connected between said hydraulic pump and said actuators, and pump control means for controlling a displacement volume of said hydraulic pump so that a delivery pressure of said hydraulic pump is held higher by a predetermined value than a maximum load pressure among said plurality of actuators, said plurality of valve means respectively having variable throttles with openings that are varied in accordance with operation signals received from operation means for controlling the flow rates of the hydraulic fluid supplied to the associated actuators, and auxiliary valves arranged in series with said variable throttles for additionally controlling the flow rates of the hydraulic fluid supplied to the associated actuators, wherein said hydraulic control system further comprises (A) first detection means for detecting a differential pressure between the delivery pressure of said hydraulic pump and said maximum load pressure and outputting a corresponding differential pressure signal; (B) second detection means for detecting an operation pattern of said plurality of actuators and outputting a corresponding operation pattern signal; and (C) valve control means for calculating valve control signals based on the differential pressure signal and the operation pattern signal outputted from said first and second detection means, respectively, to thereby control driving of said auxiliary valves, said valve control means including (a) first means for storing plural output patterns of an auxiliary valve control amount as a function of said differential pressure signal in relation to plural operation pattern signals and, when said operation pattern signal is outputted from said second detection means, for selecting one of the output patterns corresponding to the operation pattern signal outputted, followed by calculating an auxiliary valve control amount dependent upon said differential pressure signal outputted from said first detection means based on the selected output pattern; (b) second means for storing plural sets of rates of change for plural auxiliary valve control amounts in relation to said operation pattern signals and, when said operation pattern signal is outputted from said second detection means, for selecting one set of rates of change corresponding to the operation pattern signal outputted; and (c) third means for combining the auxiliary valve control amount calculated by said first means with the set of rates of change selected by said second means to calculate each said valve control signal.

With the present invention thus arranged, when at least one of the operation means is operated to drive corresponding one or more of the actuators, the second detection means outputs a corresponding operation pattern signal which is applied to the valve control means along with the differential pressure signal outputted from the first detection means. In the valve control means, one output pattern for the auxiliary valve control amount corresponding to the output operation pattern signal is first selected by the first means thereof, and the auxiliary valve control amount dependent upon the differential pressure signal is then calculated based on the selected output pattern. Accordingly, by setting the output pattern to one which is considered optimum for each of the various operation patterns, it is possible to provide the optimum distribution ratio during the combined operation that is intended. This permits independent operation of the plural actuators when they are driven simultaneously, for example.

Other than the above calculation of the output pattern, in the valve control means, one of the sets of rates of change for the control amounts corresponding to the present operation pattern is selected by the second means thereof, and the selected set is combined with the control amount obtained from the selected output pattern to calculate the valve control signal in the third means thereof. Accordingly, by setting the rate of change for the control amount dependent upon the change in the differential pressure signal such that the auxiliary valve operates at the response speed optimum for the present operation pattern, it is possible to properly control the dynamic response of the auxiliary valve upon the differential pressure signal being changed and then properly control the flow rate of the hydraulic fluid supplied to the associated actuator upon the differential pressure signal being changed, thereby realizing the superior operability free from unexpected abrupt change in the operating speed of the actuator.

In the above hydraulic control system, said first means preferably has (1) means for storing a reference pattern of said auxiliary valve control amount as a function of said differential pressure signal; (2) means for storing plural sets of variable data for said reference pattern in relation to said plural operation pattern signals and, when said operation pattern signal is outputted from said second detection means, for selecting one set of variable data corresponding to the operation pattern signal outputted; and (3) means for combining said reference pattern with said selected set of variable data to obtain said output pattern, and calculating the auxiliary valve control amount dependent upon said differential pressure signal based on said output pattern.

By determining the output pattern based on a combination of the single reference pattern and the variable data associated therewith as mentioned above, more output patterns can be stored than if the same number of output patterns were stored directly, enabling inexpensive manufacture of the valve control means.

Preferably, the plural sets of variable data for said reference pattern each include respective values of a gain for changing a gradient of said reference pattern, an offset for translating said reference pattern, a maximum limiter for limiting a maximum value of said reference pattern, and a minimum limiter for limiting a minimum value of said reference pattern.

In the above hydraulic control system, the plural sets of rates of change stored in said second means each preferably include respective values of a rates of change in the closing direction and a rates of change in the opening direction for each of said auxiliary valves.

Preferably, said third means determines that the value of said auxiliary valve control amount calculated by said first means is to operate each of said auxiliary valves in which one of the closing direction and the opening direction, selects one of said rates of change in the closing direction and said rates of change in the opening direction dependent upon the decision result, and combines said selected rates of change with the auxiliary valve control amount calculated by said first means for calculating each of said valve control signals.

Preferably, said second detection means includes operation signal detecting means for detecting the respective operation signals outputted from said operation means and outputting the corresponding operation mode signals.

Further, to achieve the above object, according to the present invention, there is provided a hydraulic control system for a construction machine comprising a hydraulic pump of variable displacement type, a plurality of actuators driven by a hydraulic fluid supplied from said hydraulic pump, a plurality of valve means connected between said hydraulic pump and said actuators, and pump control means for controlling a displacement volume of said hydraulic pump so that a delivery pressure of said hydraulic pump is held higher by a predetermined value than a maximum load pressure among said plurality of actuators, said plurality of valve means respectively having variable throttles of which openings are varied dependent upon operation signals from operation means to control flow rates of the hydraulic fluid supplied to the associated actuators, and auxiliary valves arranged in series with said variable throttles for additionally controlling the flow rates of the hydraulic fluid supplied to the associated actuators, wherein said hydraulic control system further comprises (A) first detection means for detecting a differential pressure between the delivery pressure of said hydraulic pump and said maximum load pressure and outputting a corresponding differential pressure signal; and (B) second detection means for detecting an operation pattern of said plurality of actuators and outputting a corresponding operation pattern signal, said pump control means including (a) first means for storing plural sets of control gains for said hydraulic pump in relation to plural operation pattern signals and, when said operation pattern signal is outputted from said second detection means, for selecting one set of control gains corresponding to the operation pattern signal outputted; and (b) second means for determining a deviation between said differential pressure signal outputted from said first detection means and a preset target differential pressure, calculating pump control signals to reduce said differential pressure deviation using both said differential pressure deviation and the set of control gains selected by said first means, and controlling the displacement volume of said hydraulic pump based on said pump control signals.

With the present invention thus arranged, when at least one of the operation means is operated to drive corresponding one or more of the actuators, the second detection means outputs a corresponding operation pattern signal which is applied to the pump control means along with the differential pressure signal outputted from the first detection means. In the pump control means, one set of control gains corresponding to the output operation pattern signal is selected by the first means thereof and, by using both a differential pressure deviation between the differential pressure signal and a preset target differential pressure and the selected set of control gain data, pump control signals to reduce the differential pressure deviation is calculated by the second means thereof. Accordingly, by setting the control gains dependent upon the change in the differential pressure signal such that the swash plate tilting of the hydraulic pump changes at the response speed optimum for the present operation pattern, it is possible to properly control the response speed of the swash plate tilting upon the differential pressure signal being changed and then also properly control the flow rate of the hydraulic fluid supplied to the associated actuator upon the differential pressure signal being changed, thereby minimizing unexpected abrupt changes in the operating speed of the actuator.

Preferably, the plural sets of control gains stored in said first means each include respective values of an increase gain suited for control in the increasing direction of the displacement volume of said hydraulic pump and a decrease gain suited for control in the decreasing direction of the displacement volume of said hydraulic pump.

Preferably, said second means determines that the value of said differential pressure deviation is to control the displacement volume of said hydraulic pump in which one of the increasing direction and the decreasing direction, selects one of said increase gain and decrease gain dependent upon the decision result, and calculates said pump control signals using both said selected gain and said differential pressure deviation.

Preferably, said pump control means further includes (c) third means for storing a plurality of target differential pressures between the delivery pressure of said hydraulic pump and said maximum load pressure in relation to plural operation pattern signals and, when said operation pattern signal is outputted from said second detection means, for selecting one of said target differential pressures corresponding to the operation pattern signal outputted, and said second means uses the target differential pressure selected by said third means as said preset target differential pressure. In this case, other than the above calculation of the control gain, the pump control means selects one of the target differential pressures corresponding to the present operation pattern in the third means thereof, and uses the selected target differential pressure as the present target differential pressure for calculating the pump control signal to make the differential pressure deviation smaller in the second means thereof. Accordingly, by setting the target differential pressure so as to provide the flow rate characteristic optimum for the present operation pattern, it is possible to improve a response of the flow rate change and realize the superior operability by positively supplying the hydraulic fluid to even the actuator(s) on the high load side when the operation pattern is switched over from one pattern to another.

BRIEF DESCRIPTION OF THE DRAWINGS

FIG. 6 is a table showing details of data stored in a pump control gain calculating block shown in FIG. 5.

FIG. 7 is a table showing details of data stored in a target differential pressure calculating block shown in FIG. 5.

FIG. 8 is a table showing details of data stored in a control pressure variable calculating block shown in FIG. 5.

FIG. 16 is a table showing details of data stored in the control pressure change speed calculating block shown in FIG. 5.

BEST MODE FOR CARRYING OUT THE INVENTION

Hereinafter, a hydraulic control system for construction machines according to one embodiment of the present invention will be described with reference to the drawings.

Figure 1:
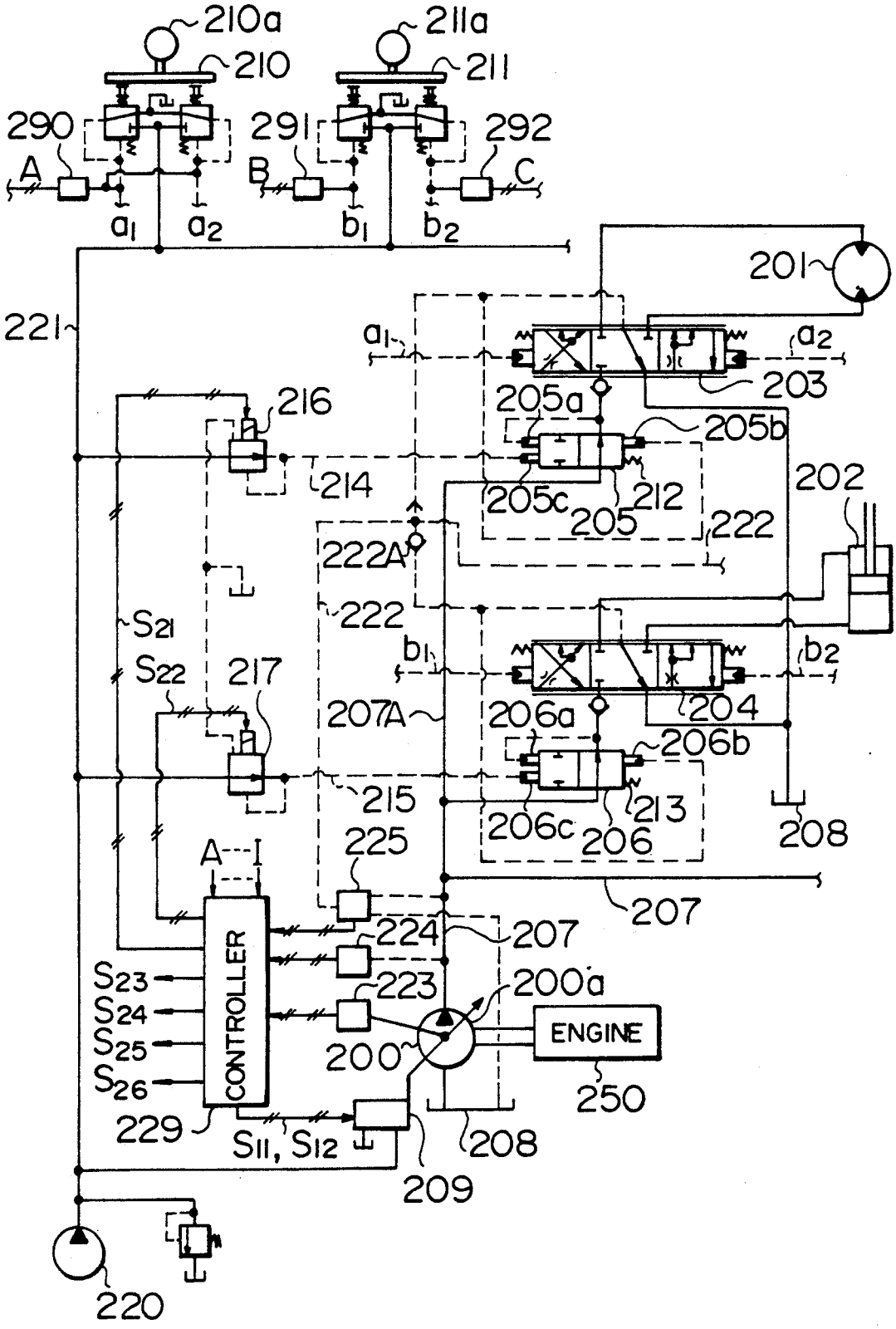
FIG. 1 is a diagram showing ⅓ of the entire arrangement of a hydraulic control system for construction machines according to one embodiment of the present invention.
Figure 2:
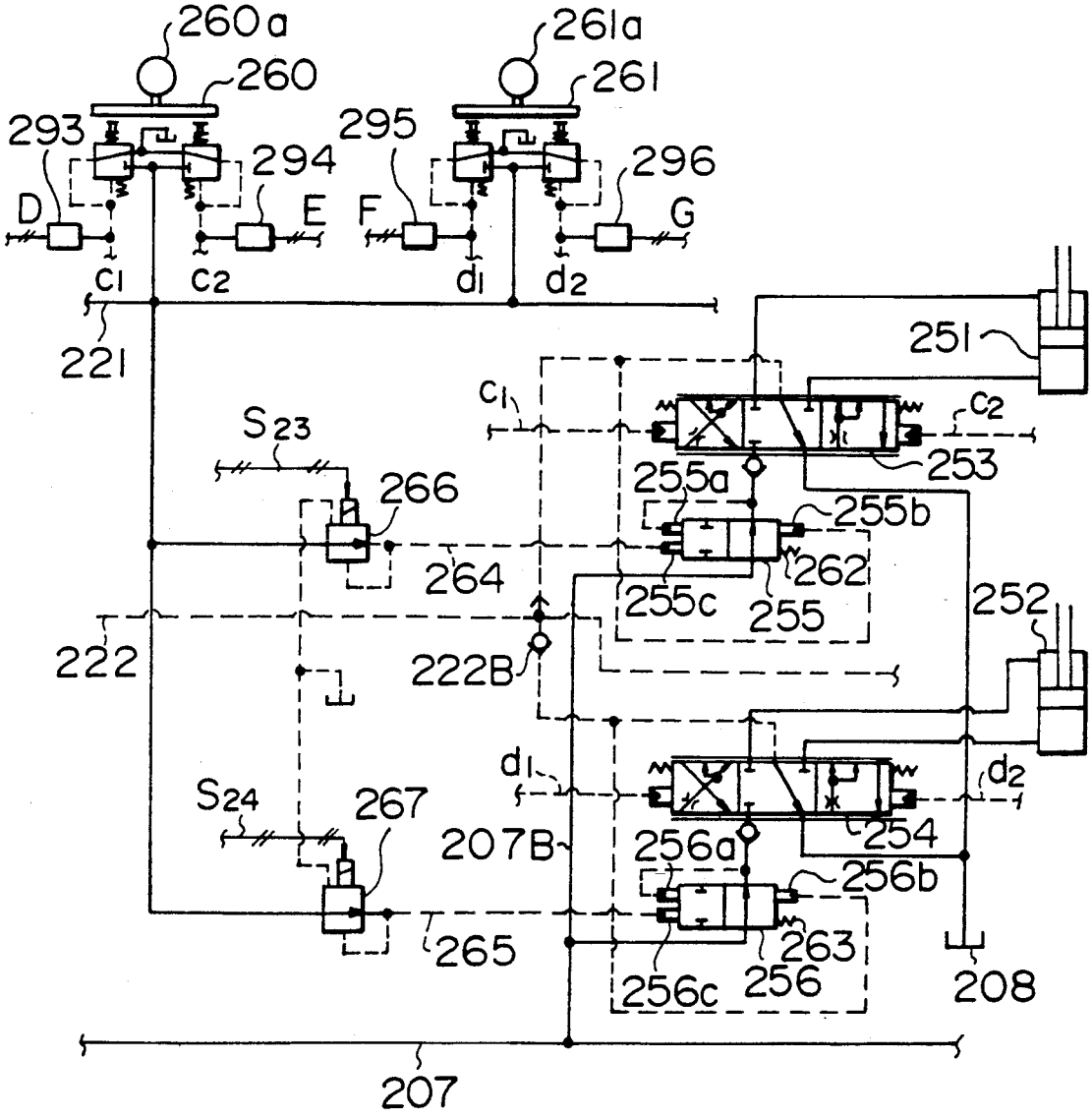
FIG. 2 is a diagram showing another ⅓ of the hydraulic control system shown in FIG. 1.
Figure 3:
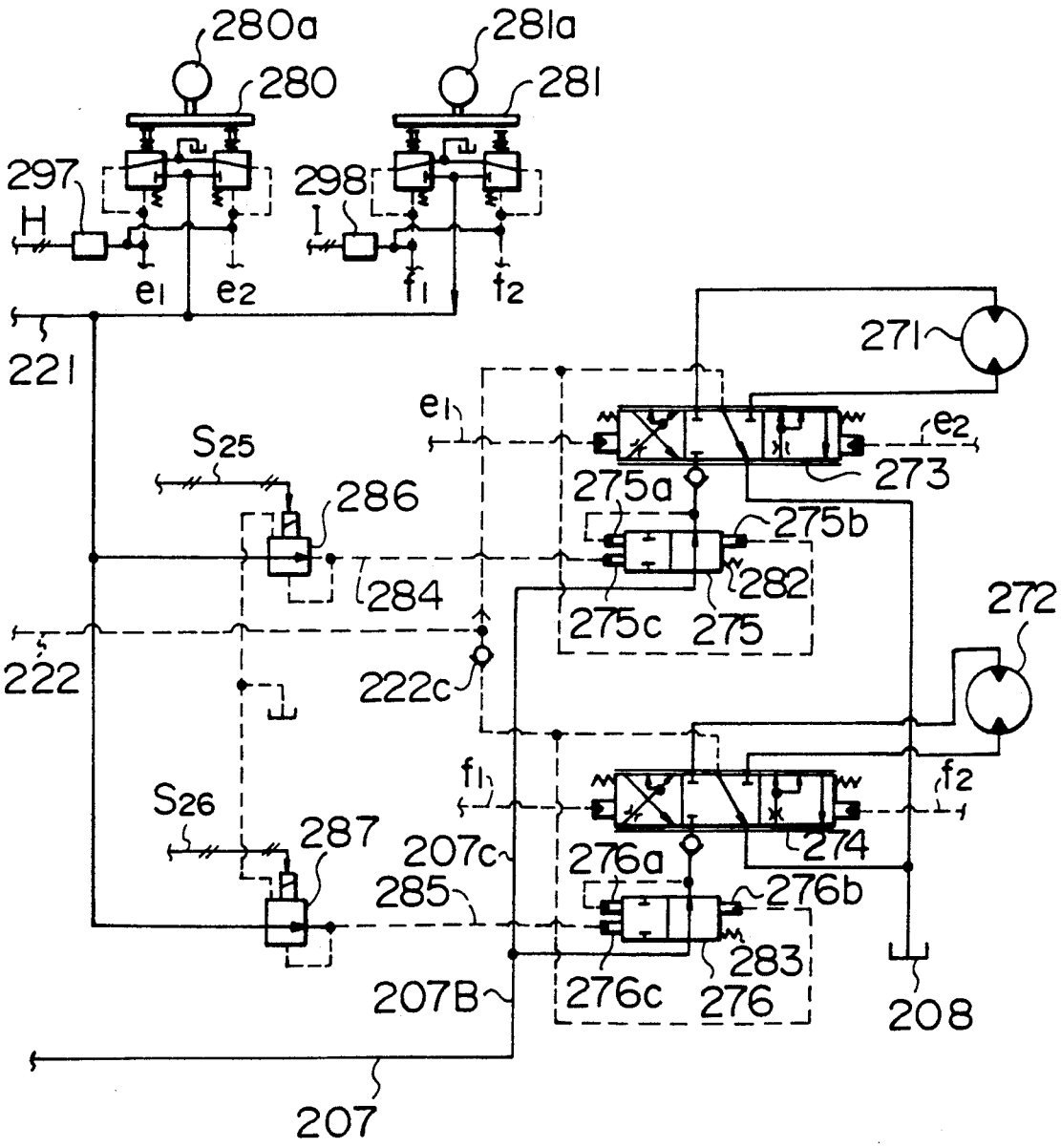
FIG. 3 is a diagram showing the remaining ⅓ of the hydraulic control system shown in FIGS. 1 and 2.

FIGS. 1 to 3 show a hydraulic control system when the present invention is applied to a hydraulic excavator. In these drawings, the hydraulic control system of this embodiment comprises a single hydraulic pump of variable displacement type, i.e., a main pump 200, which is driven by a prime mover (engine) 250, a plurality of actuators, i.e., a swing motor 201, a boom cylinder 202, an arm cylinder 251, a bucket cylinder 252, a left travel motor 271 and a right travel motor 272, which are driven by a hydraulic fluid delivered from the main pump 200, flow control valves, i.e., a swing directional control valve 203, a boom directional control valve 204, an arm directional control valve 253, a bucket directional control valve 254, a left travel directional control valve 273 and a right travel directional control valve 274, which control flows of the hydraulic fluid supplied to the respective actuators and each have a variable throttle built therein, and pressure compensating valves 205, 206, 255, 256, 275, 276 as auxiliary valves which are incorporated in the respective directional control valves in the practical structure and disposed upstream of the associated variable throttles in series to control differential pressures across the respective variable throttles, for thereby auxiliarily controlling the flow rates of the hydraulic fluid supplied to the actuators.

A delivery line 207 of the main pump 200 is connected to the pressure compensating valves 205, 206, 255, 256, 275. 276 via supply lines 207A, 207B, 207C, and a relief valve and an unloading valve, both not shown, are connected to the delivery line 207. When the hydraulic fluid from the main pump 200 reaches a preset pressure, the relief valve causes the hydraulic fluid to be discharged into a reservoir 208, whereby a delivery pressure of the main pump 200, i.e., a pump pressure, is prevented from increasing above the preset pressure. When the hydraulic fluid from the main pump 200 reaches a pressure corresponding to the sum of a maximum load pressure PLmax among the actuators 201, 202, 251, 252, 271, 272 and a preset pressure of the unloading valve, the unloading valve causes the hydraulic fluid to be discharged into the reservoir 208, whereby the pump pressure is prevented from increasing above the summation pressure.

A delivery rate of the main pump 200 is controlled by a pump control unit 209 so that the pump pressure Ps is kept higher a predetermined value ΔPLsr than the maximum load pressure PLmax, to thereby effect load sensing control.

The directional control valves 203, 204, 253, 254, 273, 274 are valves of hydraulic pilot type operated by respective operation means, for example, pilot valves 210, 211, 260, 261, 280, 281. Upon control levers **210*a*, 211*a*, 260*a*, 261*a*, 280*a*, 281*a* being manually operated, the pilot valves 210, 211, 260, 261, 280, 281** respectively produce a pilot pressure a1 or a2, a pilot pressure b1 or b2, a pilot pressure c1 or c2, a pilot pressure d1 or d2, a pilot pressure e1 or e2, a pilot pressure f1 or f2. These pilot pressures are applied to the directional control valves 203, 204, 253, 254, 273, 274, whereupon the variable throttles of the directional control valves are opened to corresponding degrees.

The pressure compensating valves 205, 206, 255, 256, 275, 276 respectively have drive sectors 205*a*, 205*b*; 206*a*, 206*b*; 255*a*, 255*b*; 256*a*, 256*b*; 275*a*, 275*b* and 276*a*, 276*b* which are supplied with an outlet pressure and an inlet pressure of the variable throttles of the directional control valves 203, 204, 253, 254, 273, 274 for applying first control pressures in the valve closing direction based on the differential pressures across the associated variable throttles, springs 212, 213, 262, 263, 282 and 283, drive sectors 205*c*, 206*c*, 206*b*, 255*c*, 256*c*, 275*c* and 276*c* which are supplied with control pressures outputted from solenoid proportional pressure reducing valves 216, 217, 266, 267, 286 and 287 via pilot lines 214, 215, 264, 265, 284 and 285, both the springs 212, 213, 262, 263, 282 and 283 and the drive sectors 205*c*, 206*c*, 206*b*, 255*c*, 256*c*, 275*c* and 276*c* applying second control forces in the valve opening direction, so that target values of the differential pressures across the associated variable throttles are set.

The pump control unit 209, the pilot valves 210, 211, 260, 261, 280, 281, and the solenoid proportional reducing valves 216, 217, 266, 267, 286, 287 are supplied with a pilot pressure from a common pilot pump 220 via a pilot line 221. Connected to the directional control valves 203, 204, the directional control valves 253, 254 and the directional control valves 273, 274 are select means, i.e., shuttle valves 222A, 222B, 222C and a detection line 222, for leading out the maximum load pressure PLmax among the actuators 201, 202, 252, 252, 271, 272.

The hydraulic control system of this embodiment has a displacement sensor 223 for detecting a displacement of a volume varying mechanism 200*a* of the main pump 200, i.e., a tilting angle (displacement volume) $\theta o$ of a swash plate in the case of a swash plate pump, a pressure sensor 224 for detecting the pump pressure Ps of the main pump 200, and a differential pressure sensor 225 to which the pump pressure Ps of the main pump 200 and the maximum load pressure PLmax among the actuators taken out into the detection line 222 are introduced for producing a signal corresponding to a differential pressure $\Delta$PLS therebetween.

Further, the hydraulic control system comprises pressure sensors 290 to 298 as means for detecting the operation patterns of the actuators. The pressure sensor 290 detects the pilot pressures a1 and a2 produced from the pilot valve 210 and then outputs an operation mode signal A for "swing". The pressure sensor 291 detects the pilot pressure b1 produced from the pilot valve 211 and then outputs an operation mode signal B for "boom-up". The pressure sensor 292 detects the pilot pressure b2 produced from the pivot valve 211 and then outputs an operation mode signal C for "boom-down". The pressure sensor 293 detects the pilot pressure c1 produced from the pivot valve 260 and then outputs an operation mode signal D for "arm pull". The pressure sensor 294 detects the pilot pressure c2 produced from the pilot valve 260 and then outputs an operation mode signal E for "arm push". The pressure sensor 295 detects the pilot pressure d1 produced from the pilot valve 261 and then outputs an operation mode signal F for "bucket pull". The pressure sensor 296 detects the pilot pressure d2 produced from the pilot valve 261 and then outputs an operation mode signal G for "bucket push". The pressure sensor 297 detects the pilot pressure e1 and e2 produced from the pilot valve 280 and then outputs an operation mode signal H for "travel left". The pressure sensor 298 detects the pilot pressures f1 and f2 produced from the pilot valve 281 and then outputs an operation mode signal I for "travel right".

The above operation mode signals A to I serve as operation pattern signals for the actuators. For example, when only the operation mode signal A is outputted, this means the operation pattern of "swing alone". When only the operation mode signal B is outputted, this means the operation pattern of "boom-up alone". When only the operation mode signals H and I are outputted, this means the operation pattern of "travel alone". As other examples, when a combination of the operation mode signal B and the operation mode signal D is outputted, this means the operation pattern of "combined operation of arm pull and boom-up", typically "level pulling". When a combination including the operation mode signal A and the operation mode signal D or E is outputted, this means the operation pattern of "combined operation of swing, arm, etc.". When a combination of the operation mode signal H and the operation mode signal I is outputted, this means the operation pattern of "driving of travel alone". When a combination of the operation mode signals H, I and the other operation mode signal is outputted, this means the operation pattern of "combined operation of travel and other", i.e., "combined travel".

The signals from the displacement sensor 223, the pressure sensor 224 and the differential pressure sensor 225, as well as the signals A to I from the pressure sensors 290 to 298 are inputted to a controller 229 for calculation of pump control signals S11, S12 and valve control signals S21, S22, S23, S24, S25, S26 which are outputted to the pump control 209 and the solenoid proportional reducing valves 216, 217, 266, 267, 286, 287.

It is to be noted that the main pump 200 and the pump control device 209 jointly constitute a hydraulic fluid supply source.

Figure 4:
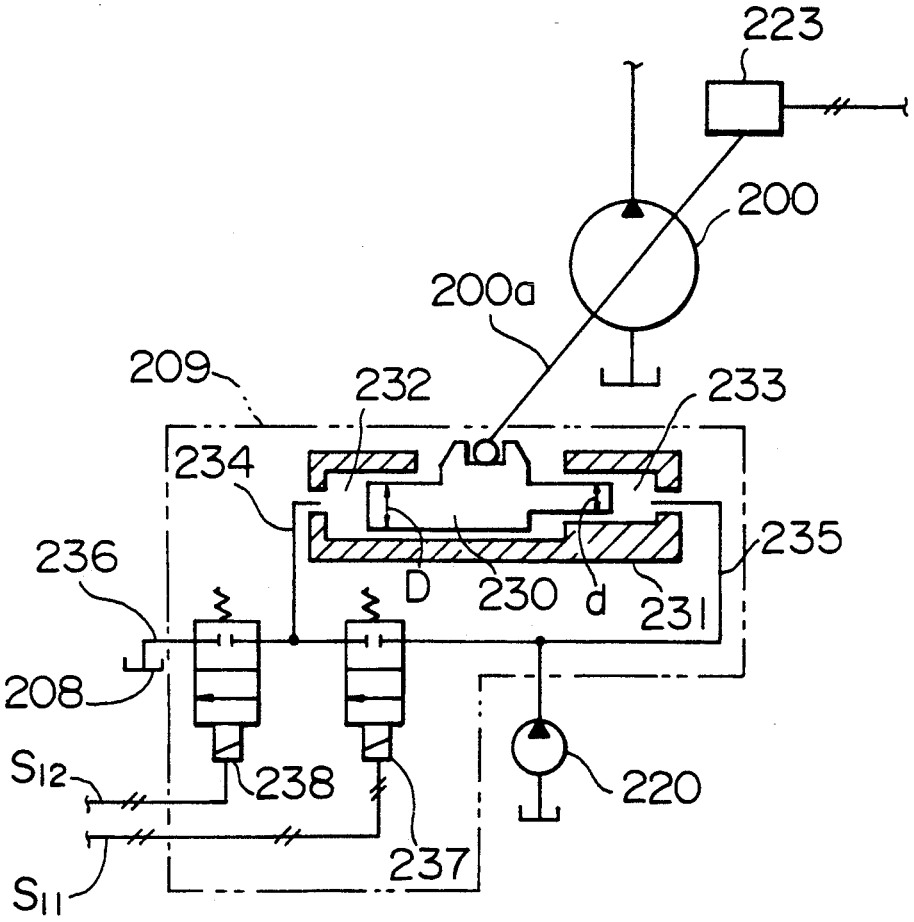
FIG. 4 is a diagram of a pump control unit shown in FIG. 1.

FIG. 4 shows the arrangement of the pump control unit 209. In this embodiment, the pump control unit 209 is constituted to be adapted for a hydraulic control system of electric-hydraulic servo type.

The pump control unit 209 has a servo piston 230 for driving a displacement varying mechanism, i.e., a swash plate 200*a*, of the main pump 200, the servo piston 230 being housed in a servo cylinder 231. A cylinder chamber of the servo cylinder 231 is divided by a servo piston 230 into a left-hand chamber 232 and a right-hand chamber 233 and is formed such that a sectional area D of the left-hand chamber 232 is larger than a sectional area d of the right-hand chamber 233.

The left-hand chamber 232 of the servo cylinder 231 is communicated with the pilot pump 220 via lines 234, 235 and the right-hand chamber 233 is communicated with the pilot pump 220 via the line 235. The lines 234, 235 are communicated with the reservoir 208 via a line 236. A solenoid valve 237 is interposed midway the line 235 and a solenoid valve 238 is interposed midway the return line 236. These solenoid valves 237, 238 are solenoid valves of normally closed type (with a function of returning to a closed state during non-energization)). The pump control signals S11, S12 are inputted to the solenoid valves 237, 238, respectively, to excite them for shifting to open positions.

When the solenoid valve 237 is shifted to the open position upon the pump control signal S11 being applied thereto, the left-hand chamber 232 of the servo cylinder 231 is communicated with the pilot pump 220 so that the servo piston 230 is moved rightwardly on the drawing due to the area difference between the left-hand chamber 232 and the right-hand chamber 233. A tilting angle of the swash plate 200*a*, i.e., the displacement volume, of the main pump 200, is thereby increased and so is the delivery rate. When the pump control signal S11 is disappeared, the solenoid valve 237 is returned to the original closed position, whereupon the communication between the left-hand chamber 232 and the right-hand chamber 233 is disconnected to hold the servo piston 230 rest at the then position. Consequently, the displacement volume of the main pump 200 is kept constant and thus the delivery rate becomes constant. When the solenoid valve 238 is shifted to the open position upon the pump control signal S12 being applied thereto, the left-hand chamber 232 is communicated with the reservoir 208 so that the pressure in the left-hand chamber 232 is reduced and the servo piston 230 is moved leftwardly on the drawing due to the pressure in the right-hand chamber 233. The displacement volume of the main pump 200 is thereby decreased and so is the delivery rate.

By so making on/off control of the solenoid valves 237, 238 using the pump control signals S11, S12 to control the displacement volume of the main pump 200, the displacement volume of the main pump 200 is controlled to come into match with a target tilting angle $\theta r$ calculated by the controller 229.

Figure 5:
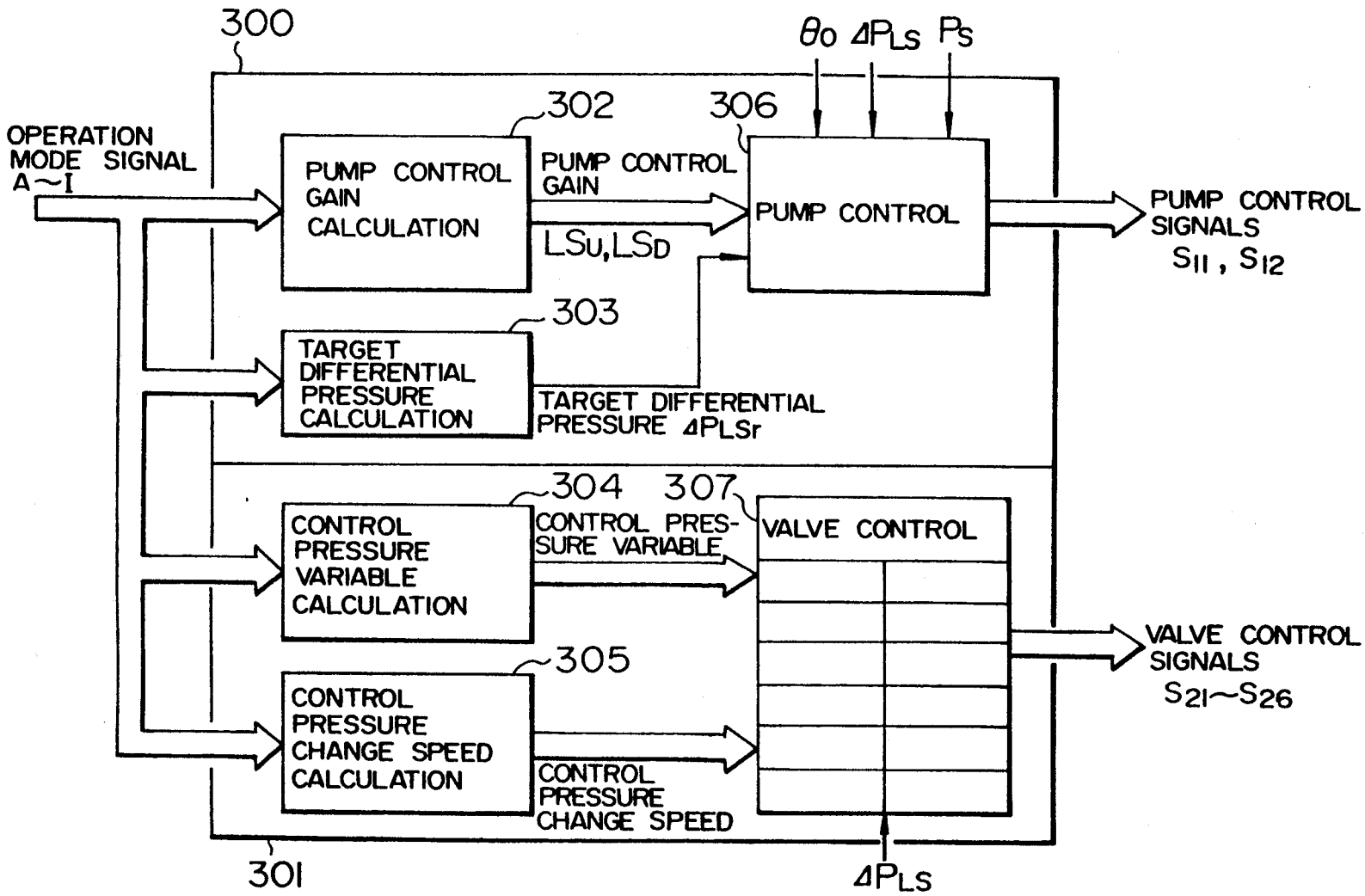
FIG. 5 is a block diagram showing a pump control signal calculating function and a valve control signal calculating function both equipped in a controller shown in FIG. 1.

FIG. 5 is a block diagram showing a pump control signal calculating function 300 and a valve control signal calculating function 301 both included in the aforesaid controller 229.

The pump control signal calculating function 300 comprises a pump control gain calculating block 302, a target differential pressure calculating block 303, and a pump control section 306. The pump control gain calculating block 302 stores therein plural sets of pump control gains, each determining a response speed of swash plate tilting of the main pump 200 during the load sensing control, in relation to the operation mode signals A to I and combinations thereof (i.e., the operation patterns) and, when one or more of the operation mode signals A to I are outputted from the pressure sensors 290 to 298, it selects one set of control gains corresponding to the output of the operation mode signals A to I and combinations thereof. The target differential pressure calculating block 303 stores therein plural values of the target differential pressure $\Delta LSr$ between the pump pressure Ps and the maximum load pressure PLmax during the load sensing control in relation to the operation mode signals A to I and combinations thereof (i.e., the operation patterns) and, when one or more of the operation mode signals A to I are outputted from the pressure sensors 290 to 298, it selects one value of the target differential pressure corresponding to the output of the operation mode signals A to I and combinations thereof. The pump control section 306 calculates the pump control signals S11, S12 based on the pump control gain data outputted from the pump control gain calculating block 301, the target differential pressure outputted from the target differential pressure calculating block 303, the differential pressure signal $\Delta PLs$, the pump pressure signal Ps, and the pump tilting signal $\theta o$, followed by outputting the calculated pump control signals S11, S12 to the solenoid valves 237, 238 of the pump control unit 209.

The valve control signal calculating function 301 comprises a control pressure variable calculating block 304, a control pressure rates of change calculating block 305 and a valve control section 307. The control pressure variable calculating block 304 stores therein plural sets of variable data with respect to a reference pattern (later described) of the pressure compensating valve control pressure stored as a function of the differential pressure signal $\Delta PLS$, in relation to the operation mode signals A to I and combinations thereof (i.e., the operation patterns) and, when one or more of the operation mode signals A to I outputted from the pressure sensors 290 to 298, it selects one set of variable data corresponding to the output of the operation mode signals A to I and combinations thereof. The control pressure change speed calculating block 305 stores therein plural sets of rates of change for the pressure compensating valve control pressures in relation to the operation mode signals A to I and combinations thereof (i.e., the operation patterns) and, when one or more of the operation mode signals A to I are outputted from the pressure sensors 290 to 298, it selects one set of rates of change corresponding to the output of the operation mode signals A to I and combinations thereof. The valve control section 307 calculates the valve control signals S21 to S26 based on the variable data outputted from the control pressure variable calculating block 304, the change speed data outputted from the control pressure change speed calculating block 305, and the differential pressure signal $\Delta PLS$, followed by outputting the calculated valve control signals S21 to S26 to the pressure compensating valves 205, 206, 255, 256, 275, 276.

In the pump control gain calculating block 302, the target differential pressure calculating block 303, the control pressure variable calculating block 304 and the control pressure change speed calculating block 305, the operation mode signals A to I and combinations thereof (i.e., the operation patterns) to be related with the respective data stored in those blocks are preset identical to one another in this embodiment. The operation patterns include, for example, the above-mentioned "swing alone", "boom-up alone", "travel alone", "combined operation of arm pull and boom-up", typically "level pulling", "combined operation of swing, arm and other", and "combined operation of travel and other", i.e., "combined travel". Alternatively, the operation mode signals A to I and combinations thereof (i.e., the operation patterns) to be related with the stored data may be preset different from one another in the pump control gain calculating block 302, the target differential pressure calculating block 303, the control pressure variable calculating block 304 and the control pressure change speed calculating block 305.

Details of the data stored in the pump control gain calculating block 302, the target differential pressure calculating block 303, the control pressure variable calculating block 304 and the control pressure change speed calculating block 305 will now be described with reference to FIGS. 6 to 16.

In the pump control gain calculating block 302, as shown in FIG. 6, memory area numbers are defined corresponding to the operation mode signals A to I and combinations thereof (i.e., the operation patterns), and values of the increase gain LSU and the decrease gain LSD for determining response speeds of pump tilting during the load sensing control, which speeds are considered optimum for the respective operation patterns, are stored in memory areas of the corresponding numbers. When one or more of the operation mode signals A to I are outputted from the pressure sensors 290 to 298, the memory area of the number corresponding to the output operation mode signal or combinations thereof is referred to read the values of the gains LSU and LSD stored in that memory area.

In the target differential pressure calculating block 303, as shown in FIG. 7, memory area numbers are defined corresponding to the operation mode signals A to I and combinations thereof (i.e., the operation patterns), and values of the target differential pressure ΔLSr during the load sensing control, which values are considered optimum for the respective operation patterns, are stored in memory areas of the corresponding numbers. When one or more of the operation mode signals A to I are outputted from the pressure sensors 290 to 298, the memory area of the number corresponding to the output operation mode signal or combinations thereof is referred to read the value of the target differential pressure ΔLSr stored in that memory area.

In the control pressure variable calculating block 304, as shown in FIG. 8, memory area numbers are defined corresponding to the operation mode signals A to I and combinations thereof (i.e., the operation patterns), and values of a gain G, an offset O, a MAX limiter MA and a MIN limiter MI as variable data with respect to a reference pattern (described later) of each pressure compensating valve control pressure, which values are considered optimum for the respective operation patterns, are stored in memory areas of the corresponding numbers. When one or more of the operation mode signals A to I are outputted from the pressure sensors 290 to 298, the memory area of the number corresponding to the output operation mode signal or combinations thereof is referred to read the variable data stored in that memory area.

Here, the gain G, the offset O, the MAX limiter MA and the MIN limiter MI are variables with respect to the reference pattern of the pressure compensating valve control pressure. From both the reference pattern and the variable data, an output pattern for the pressure compensating valve control pressure is determined. This point will now be explained in detail.

By making the compensation pressure ΔPc of the pressure compensating valve become ΔPc in match with the differential pressure signal ΔPLS, the differential pressure across the variable throttle built in the directional control valve also becomes ΔPLS and the distribution ratio during the combined operation is given by the ratio of openings of the variable throttles. Since the flow rate of the hydraulic fluid passing through the variable throttle of each directional control valve is expressed by the following general formula;

$$Q = C \cdot y \sqrt{\Delta PLS} \quad \text{(C: flow rate coefficient)}$$

the pump delivery rate Qp is given below:

$$\begin{aligned} Qp &= Q1 + Q2 + \ldots \\ &= C \cdot \{y1 + y2 + \ldots\} \sqrt{\Delta PLS} \end{aligned}$$

Figure 9:
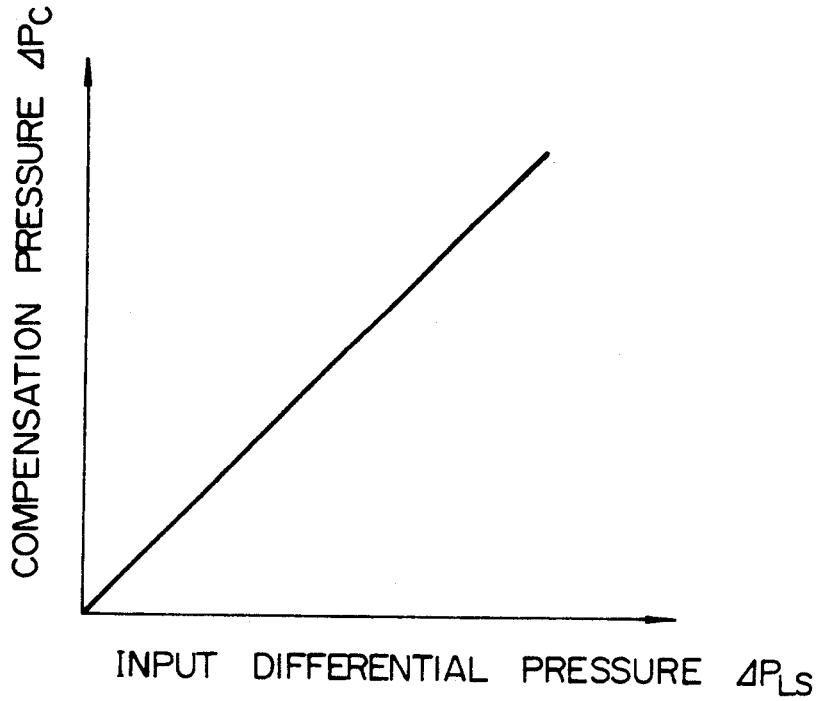
FIG. 9 is a graph showing a reference line of the compensation pressure relative to the input differential pressure.

The relationship between the compensation pressure ΔPc and the input differential pressure, i.e., the differential pressure signal ΔPLS is expressed as shown in FIG. 9. Assuming that a characteristic line shown in FIG. 9 represents the reference line, the hydraulic fluid is supplied at a larger flow rate on the upper side of the reference line shown in FIG. 9, i.e., when the compensation pressure ΔPc is greater than the input differential pressure ΔPLS, during the combined operation, while it is supplied at a smaller flow rate on the lower side, i.e., when the compensation pressure ΔPc is less than the input differential pressure ΔPLS. As regards to the flow rate, therefore, priority is given to the upper side of the illustrated reference line rather than the lower side.

On the other hand, in FIG. 1, if the control pressure Pc introduced to the pilot line 215, for example, is increased, the compensation pressure ΔPc in the pressure compensating valve 206 is decreased. Accordingly, the relationship between the compensation pressure ΔPc and the control pressure Pc becomes a reversal to that shown in FIG. 9 and can be expressed by a reference line shown in FIG. 10. For the reference line shown in FIG. 10, priority is given to the lower side rather than the upper side.

Figure 10:
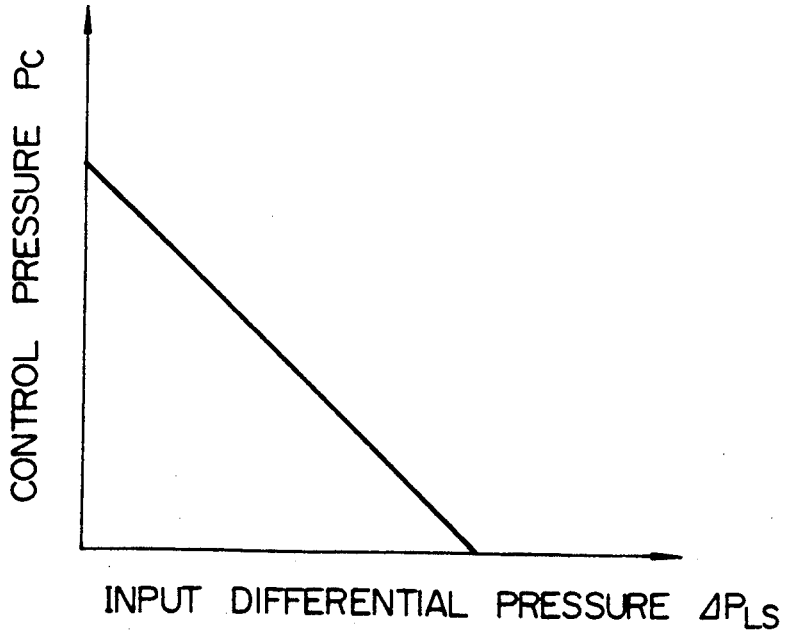
FIG. 10 is a graph showing a reference line as a reference pattern of the control pressure relative to the input differential pressure.

In this embodiment, the reference line shown in FIG. 10 is stored as the reference pattern of the pressure compensating valve control pressure (described later), and a desired output pattern is obtained by properly selecting values of the gain G, the offset O, the MAX limiter MA and the MIN limiter MI as the variable data with respect to the reference pattern.

Figure 11:
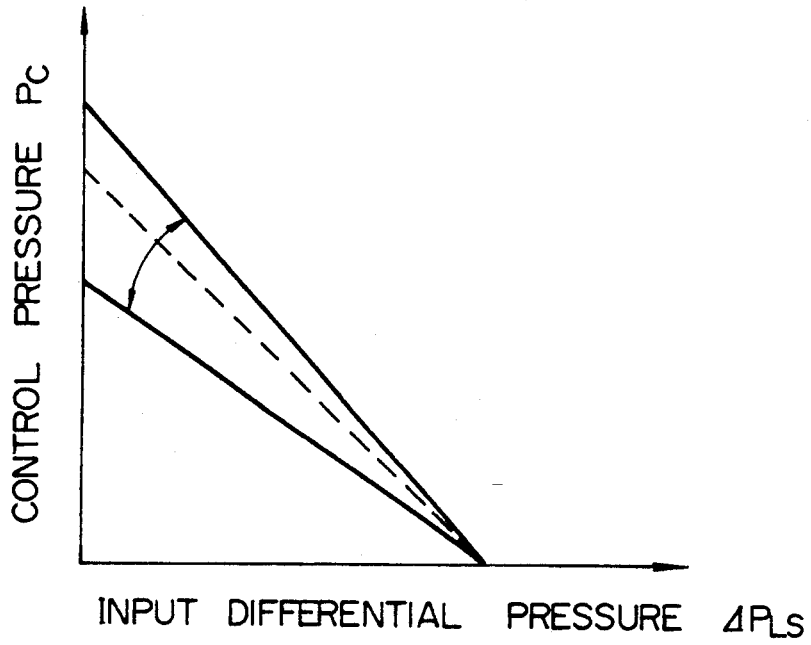
FIG. 11 is a graph showing change in characteristic due to a gain among the variable data stored in the control pressure variable calculating block.
Figure 12:
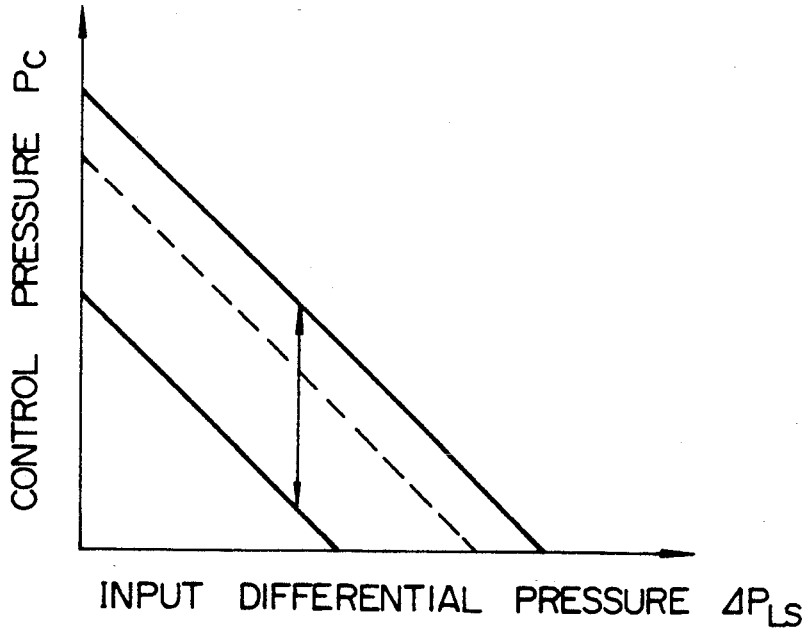
FIG. 12 is a graph showing change in characteristic due to an offset among the variable data stored in the control pressure variable calculating block.

More specifically, the gain G is a variable for changing a gradient of the reference line shown in FIG. 10 and multiplication of its value by the reference line changes the characteristic as indicated by solid lines in FIG. 11. The offset O is a variable for translating the reference line and addition of its value to the reference line changes the characteristic as indicated by solid lines in FIG. 12. The MAX limiter MA is a variable for specifying an upper limit of the reference line (i.e., an upper limit of the control pressure Pc) and modification of its value changes the characteristic as indicated by solid lines in FIG. 13. The MIN limiter MI is a variable for specifying a lower limit of the reference line (i.e., a lower limit of the control pressure Pc) and modification of its value changes the characteristic as indicated by solid lines in FIG. 14. Thus, by properly selecting and combining the values of the gain G, the offset O, the MAX limiter MA and the MIN limiter MI, there can be obtained any desired output pattern as exemplified in FIG. 15.

By determining the output pattern based on the single reference pattern and the variable data associated therewith as explained above, it is possible to store many output patterns with smaller storage capacity than the case of directly storing the output patterns in the same number, and to manufacture the valve control means inexpensively.

Further, in the control pressure change speed calculating block 305, as shown in FIG. 16, memory area numbers are defined corresponding to the operation mode signals A to I and combinations thereof (i.e., the operation patterns), and values of change speeds KBMU . . . KTRU in the closing direction and change speeds KBMD . . . KTRD in the opening direction are stored as control pressure change speeds, which are considered optimum for the respective operation patterns, in memory areas of the corresponding numbers.

When one or more of the operation mode signals A to I are outputted from the pressure sensors 290 to 298, the memory area of the number corresponding to the output operation mode signal or combinations thereof is referred to read the change speed data stored in that memory area.

Details of the pump control section 306 shown in FIG. 5 will be next described with reference to FIG. 17.

Figure 17:
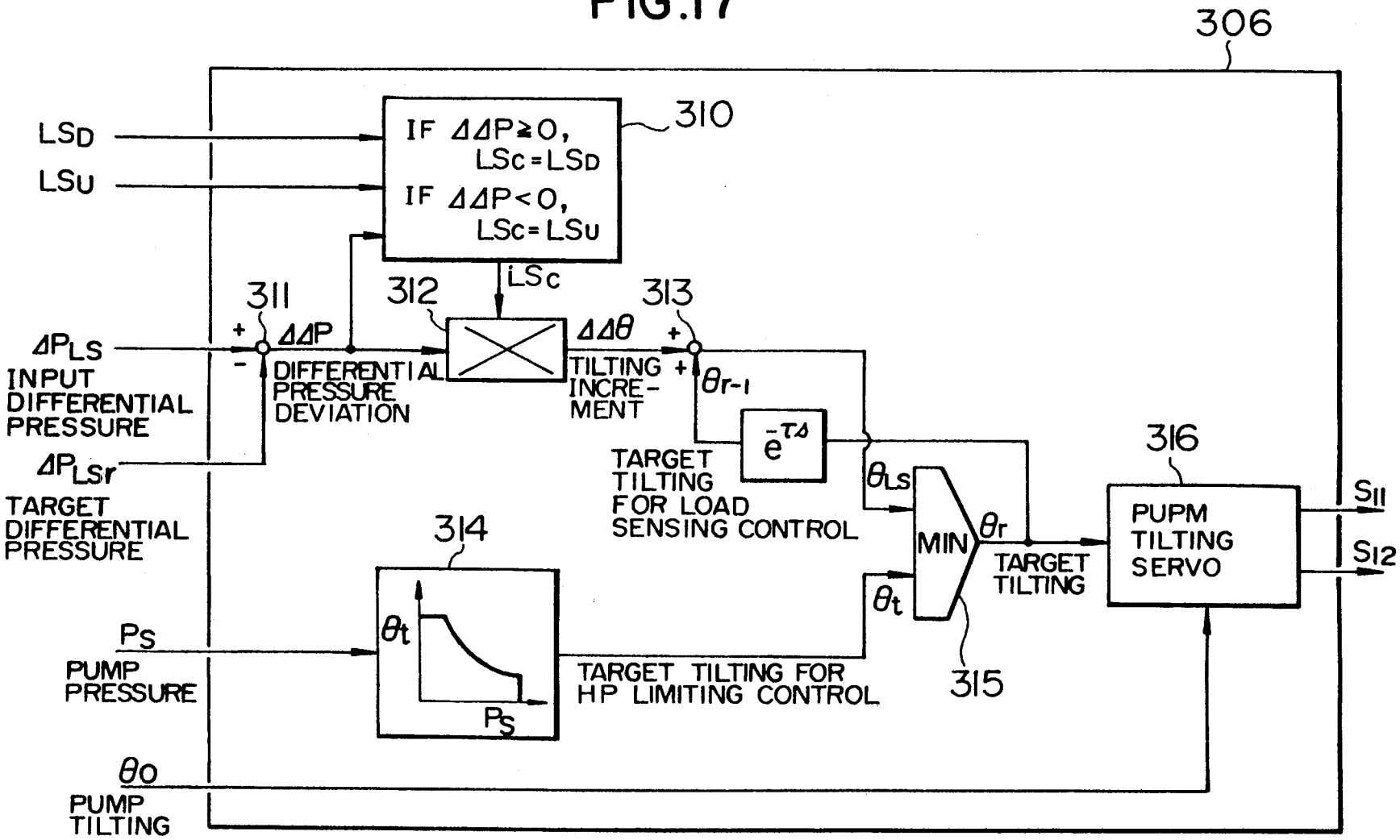
FIG. 17 is a diagram showing the arrangement of a pump control unit shown in FIG. 5.

In FIG. 17, the difference between the differential pressure signal outputted from the differential pressure sensor 225, i.e., the input differential pressure ΔPLS, and the target differential pressure ΔPLSr outputted from the target differential pressure calculating block 303 shown in FIG. 5 is obtained as a differential pressure deviation ΔΔP (=ΔPLS−ΔPLSr) by an adder 311. This differential pressure deviation ΔΔP is inputted to a decision block 310 along with the pump control gains LSD and LSU outputted from the pump control gain calculating block 302 shown in FIG. 5. The decision block 310 first determines the sign of the differential pressure deviation ΔΔP. If ΔΔP is zero or positive, this means that differential pressure is too large. Therefore, in order to reduce the flow rate delivered from the main pump 200, the gain LSc is set to the pump control gain LSD for decrease of the flow rate (i.e., LSc=LSD). If ΔΔP is negative, this means that differential pressure is too small. Therefore, in order to increase the flow rate delivered from the main pump 200, the gain LSc is set to the pump control gain LSU for increase of the flow rate (i.e., LSc=LSU). The gain LSc thus set is outputted to a multiplier 312. In the multiplier 312, the differential pressure deviation ΔΔP is multiplied by the gain LSc to calculate a tilting increase ΔΔθ (ΔΔP×LSc). Thus, when the differential pressure deviation ΔΔP is large, or when the gain LSc is large, the tilting increment ΔΔθ becomes large and an increase/-decrease response of the swash plate tilting, i.e., the displacement volume, of the main pump 200 is quick. Conversely, when the differential pressure deviation ΔΔP is small, or when the gain LSc is small, the tilting increment ΔΔθ becomes small and an increase/-decrease response of the swash plate tilting of the main pump 200 is slow. The tilting increment ΔΔθ obtained in this way is added in an adder 313 with the target tilting θr−1 before a certain fixed time, i.e., τ sec, thereby obtaining a target tilting θLS (=ΔΔθ+θr−1) for the load sensing control.

On the other hand, since the prime mover 250 for driving the main pump 200 shown in FIG. 1 undergoes limitation in maximum horsepower (HP), an allowable maximum tilting θt corresponding to the pump pressure Ps is obtained in a function generator 314 for horsepower limiting control of the prime mover 250. A minimum value between the target tilting θLS for the load sensing control and the target tilting θt for the horsepower limiting control, both derived as mentioned above, is selected by a minimum value selecting block 315 and outputted as a target tilting θr to a pump tilting servo 316. The pump tilting servo 316 determines a difference between the actual pump tilting θo outputted from the displacement sensor 223 shown in FIG. 1 and the above target tilting θr, followed by outputting the pump control signals S11, S12 dependent upon that difference to the solenoid valves 237, 238 shown in FIG. 4, respectively.

Details of the valve control section 307 shown in FIG. 5 will be next described with reference to FIG. 18.

Figure 18:
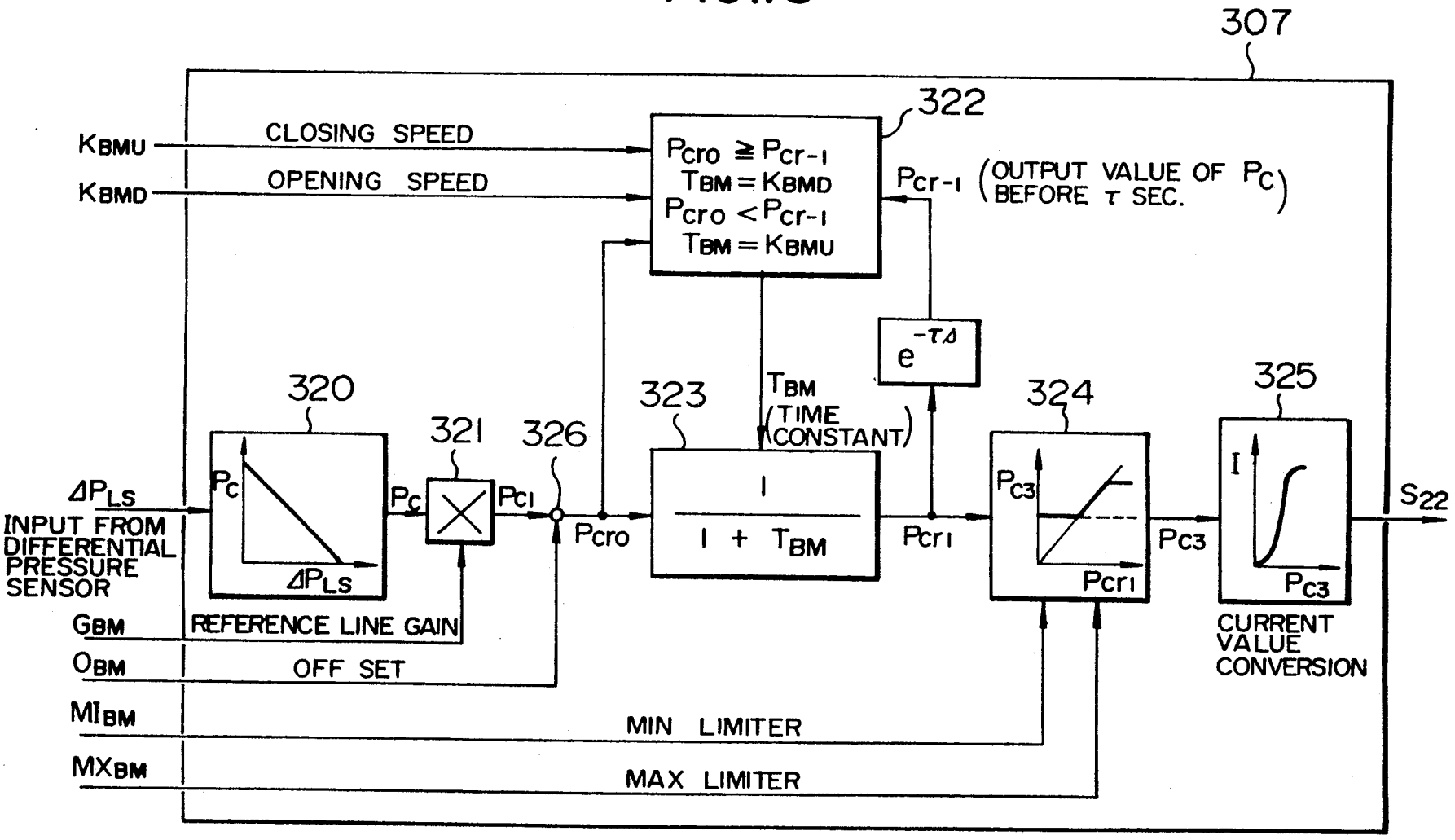
FIG. 18 is a diagram showing the arrangement of a valve control unit shown in FIG. 5.

In FIG. 18, a function generator 320 stores therein the aforesaid characteristic of the reference line shown in FIG. 10 as the reference pattern of the pressure compensating valve control pressure with respect to the input differential pressure ΔPLS. The control pressure Pc corresponding to the differential pressure signal ΔPLS outputted from the differential pressure sensor 225 shown in FIG. 1 is obtained from the function generator 320 and outputted to a multiplier 321. The multiplier 321 carries out the process of changing the gradient of the reference line shown in FIG. 11 as mentioned before. More specifically, the gain G outputted from the control pressure variable calculating block 304, for example, the gain GBM for the boom, is multiplied by the control pressure Pc outputted from the function generator 320 to calculate a target control pressure Pc1 which is outputted to an adder 326. The adder 326 carries out the process of translating the reference line shown in FIG. 12 as mentioned before. More specifically, the offset O outputted from the control pressure variable calculating block 304, for example, the offset OBM for the boom, is multiplied by the target control pressure Pc1 outputted from the multiplier 321 to calculate a new target control pressure Pcr0 which is outputted to a decision block 322 and a delay time processing block 323.

In the delay time processing block 323, the target control pressure Pcr0 outputted from the adder 326 is subjected to a primary delay filter of time constant TBM for obtaining a new target control pressure Pcr1 which is outputted to a calculation block 324.

Figure 13:
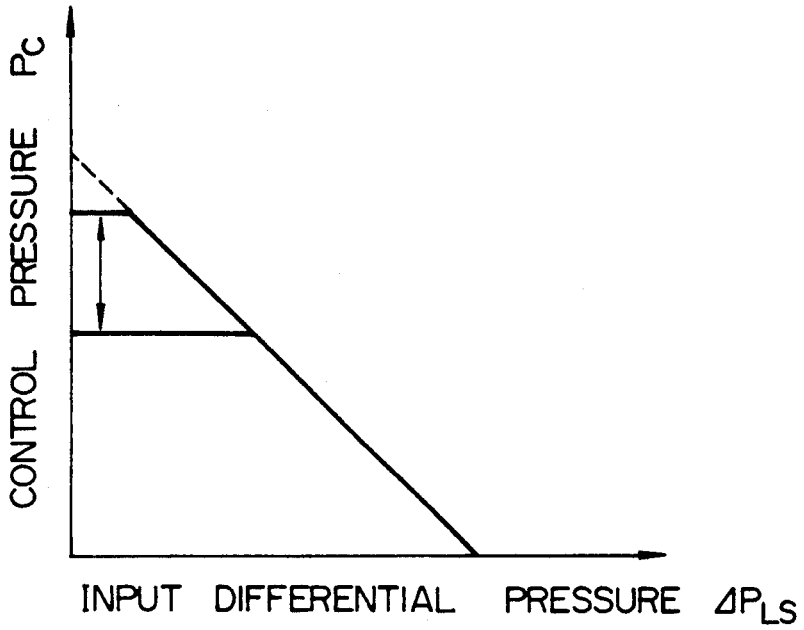
FIG. 13 is a graph showing change in characteristic due to a MAX limiter among the variable data stored in the control pressure variable calculating block.
Figure 14:
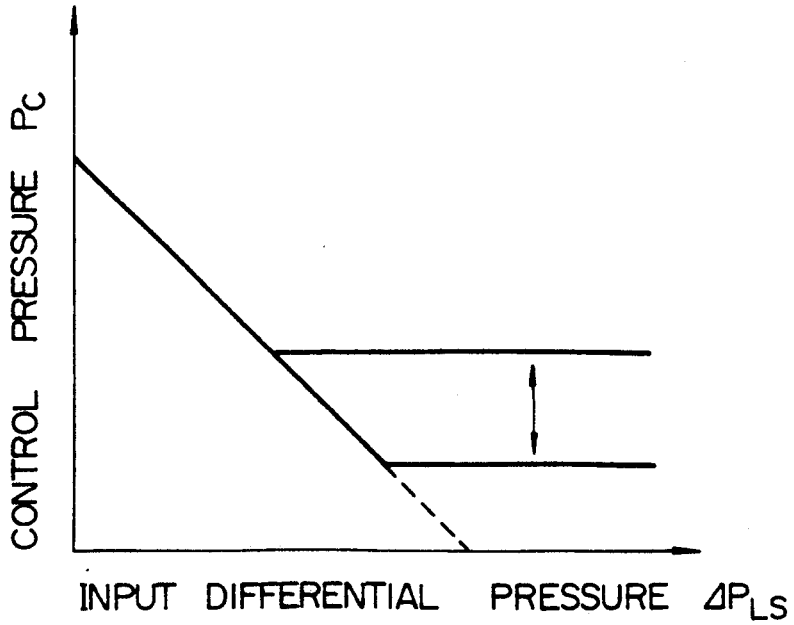
FIG. 14 is a graph showing change in characteristic due to a MIN limiter among the variable data stored in the control pressure variable calculating block.
Figure 15:
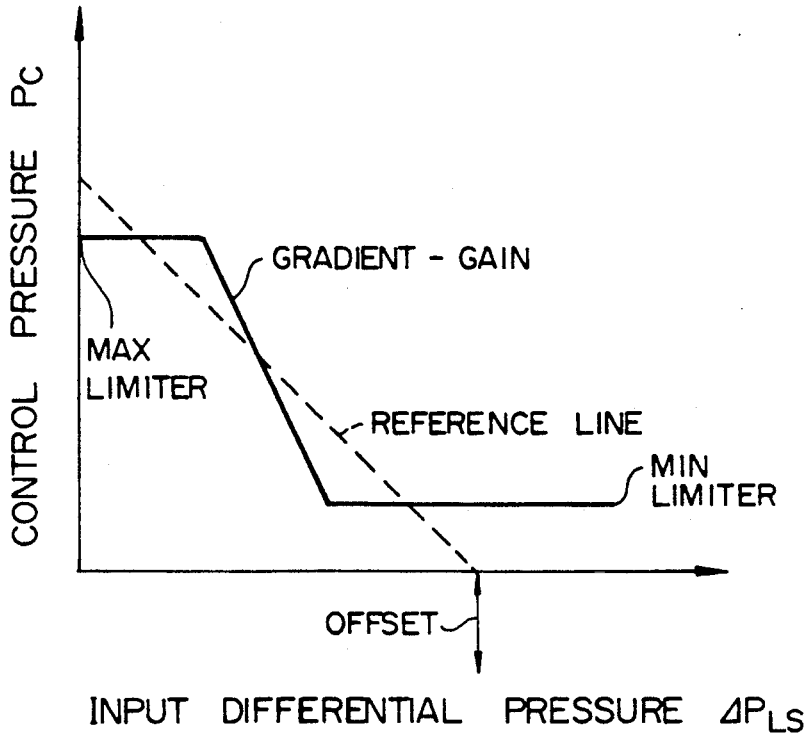
FIG. 15 is a graph showing an output pattern resulted from superposing the changes in characteristics due to the gain, offset, MAX limiter and MIN limiter.

The calculation block 324 carries out the process of defining the upper and lower limits of the control pressure shown in FIGS. 13 and 14 as mentioned before. More specifically, the MAX limiter MA and MIN limiter MI outputted from the control pressure variable calculating block 304, for example, the MAX limiter MABM and the MIN limiter MIBM both for the boom, are applied to the calculation block 324 along with the target control pressure Pcr1 outputted from the delay time processing block 323, whereby Pc3=Pcr1 is set if the target control pressure Pcr1 is larger than MIN limiter MIBM and smaller than the MAX limiter MABM, Pc3=MIBM is set if it is smaller than the MIN limiter MIBM, and Pc3=MABM is set if it is larger than the MAX limiter MABM. This target control pressure Pc3 is outputted to a current value converter 325.

Meanwhile, applied to the decision block 322 are the target control pressure Pcr0 outputted from the adder 326, the target control pressure Pcr-1 before τ sec. outputted from the delay time processing block 323, and the control pressure rates of change data outputted from the control pressure change speed calculating block 305 shown in FIG. 5, for example, the rates of change KBMU in the closing direction and the rates of change KBMD in the opening direction for the boom. The decision block 322 first determines which one of Pcr0 and Pcr-1 is larger than the other. If Pcr0≧Pcr-1, this means that the target control pressure Pcr1 is in the decreasing direction and, therefore, TBM=KBMD (change speed in the opening direction) is set. If Pcr0<Pcr-1 this means that the target control pressure Pcr1 is in the increasing direction and, therefore, TBM=KBMU (change speed in the closing direction) is set. The time constant TBM thus set is inputted to the delay time processing block 323. By so setting the time constant and effecting the primary delay filter in the delay time processing block 323 to obtain the new target control pressure Pcr1, the primary delay dependent upon the change speed KBMU in the closing direction and the change speed KBMD in the opening direction is given to the target control pressure Pcr1 in the increasing direction and the decreasing direction, respectively, which is inputted to the calculation block 324. As a result, the operating speed of the pressure compensating valve 206 in the closing direction and the opening direction is controlled to thereby control a dynamic response of the pressure compensating valve.

In the current value converter 325, a current value I corresponding to the target control pressure Pc3 is obtained from the preset relationship and then outputted as the valve control signal S22 to the solenoid proportional pressure reducing valve 217.

In the valve control section 307, the valve control signals S21 and S23 to S26 for the other pressure compensating valves are also obtained in a like manner.

In this embodiment arranged as mentioned above, when the operation means for the pilot valves 210, 211, etc. are operated, the operation mode signals A, B, C, etc. are outputted from the pressure sensors 290, 291, 252, etc. and then applied to the valve control signal calculating function 301 of the controller 229. In the valve control signal calculating function 301, the control pressure variable calculating block 304 selects the variable data corresponding to the output operation mode signal or combinations thereof (i.e., the operation pattern). Based on both the selected variable data and the reference pattern set in the function generator 320, the valve control section 307 derives the output pattern of the pressure compensating valve control pressure. The control pressure of the pressure compensating valve corresponding to the differential pressure signal at the present time is then obtained from the output pattern. By properly setting the variable data, i.e., the gain G, the offset O, the MAX limiter MA and the MIN limiter MI in the above process as mentioned before, the output pattern for the control pressure can be set to any desired pattern. Accordingly, by setting the output pattern to one which is considered optimum for each of the various operation patterns, it is possible to provide the optimum distribution ratio during the combined operation intended and to improve the operability in such a point as securing independent operations of the plural actuators when they are driven simultaneously, for example.

Other than the above calculation of the output pattern, in the valve control signal calculating function 301, the control pressure rates of change calculating block 305 selects the control pressure rates of change data corresponding to the present operation mode signal or combinations thereof (i.e., the operation pattern), and the valve control section 307 combines the selected rates of change data with the control pressure obtained from the above output pattern to calculate the valve control signal. Therefore, by setting the control pressure rates of change dependent upon the change in the differential pressure signal such that the pressure compensating valve operates at the response speed optimum for the present operation pattern, it is possible to properly control the dynamic response of the pressure compensating valve upon the differential pressure signal being changed and then properly control the flow rate of the hydraulic fluid supplied to the associated actuator upon the differential pressure signal being changed, thereby realizing the superior operability free from unexpected abrupt change in the operating speed of the actuator.

Moreover, in this embodiment, the operation mode signals A, B, C, etc. outputted from the pressure sensors 290, 291, 252, etc. are also applied to the pump control signal calculating function 300 of the controller 229. In the pump control signal calculating function 300, the pump control gain calculating block 302 selects the control gain data corresponding to the output operation mode signal or combinations thereof (i.e., the operation pattern). Based on both the selected control gain data and the differential pressure deviation between the differential pressure signal and the preset target differential pressure, the pump control section 306 calculates the pump control signal for reducing the differential pressure deviation. Therefore, by setting the control gain dependent upon the change in the differential pressure signal such that the swash plate tilting of the hydraulic pump changes at the response speed optimum for the present operation pattern, it is possible to properly control the response speed of the swash plate tilting upon the differential pressure signal being changed and then also properly control the flow rate of the hydraulic fluid supplied to the associated actuator upon the differential pressure signal being changed, thereby realizing the superior operability free from unexpected abrupt change in the operating speed of the actuator.

Other than the above calculation of the control gain, in the pump control signal calculating function 300, the target differential pressure calculating block 303 selects the target differential pressure corresponding to the present operation mode signal or combinations thereof (i.e., the operation pattern), and the pump control section 306 uses the selected target differential pressure for calculating the pump control signal to make the differential pressure deviation smaller. Therefore, by setting the target differential pressure so as to provide the flow rate characteristic optimum for the present operation pattern, it is possible to improve a response of the flow rate change and realize the superior operability in such a point as positively supplying the hydraulic fluid to even the actuator(s) on the high load side when the operation pattern is switched over from one to another.

Practical examples of the output patterns to be set for the various operation patterns will be next described along with their specific advantages.

Figure 19:
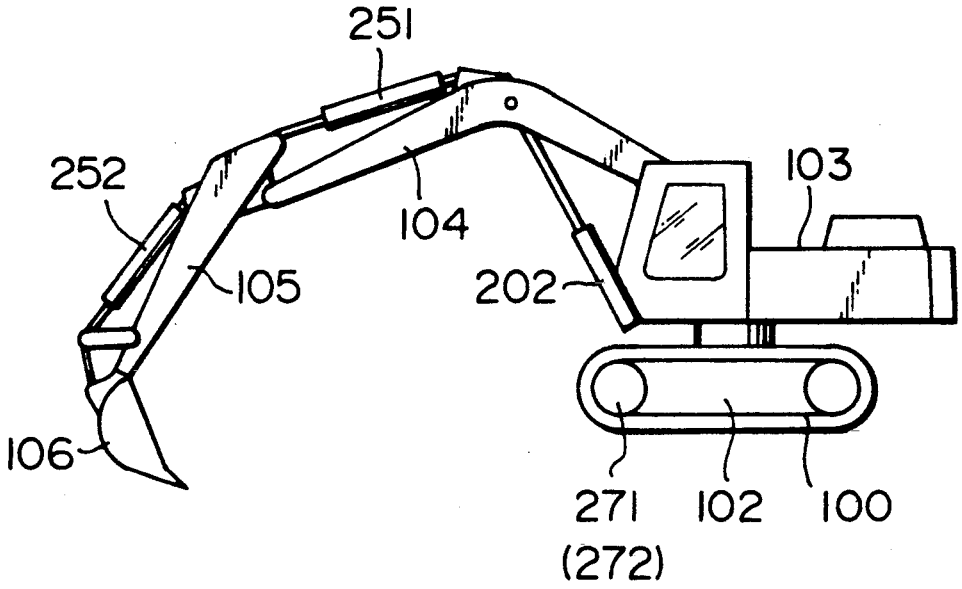
FIG. 19 is a side view of a hydraulic excavator on which the hydraulic control system shown in FIGS. 1 to 3 is mounted.
Figure 20:
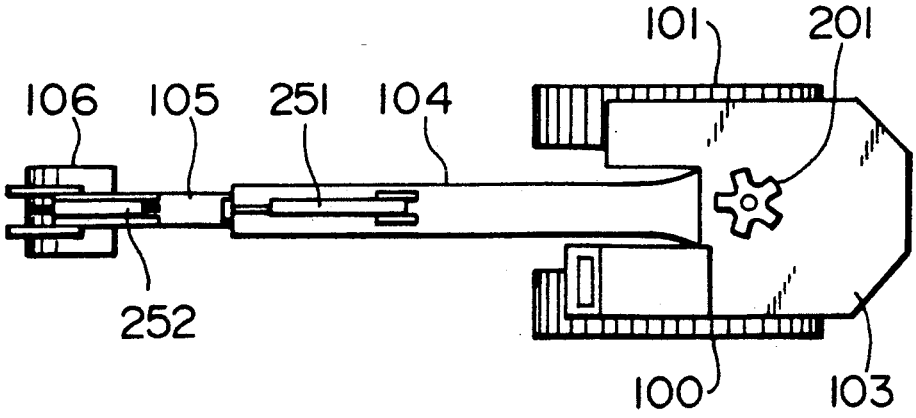
FIG. 20 is a plan view of the hydraulic excavator.

For easier understanding of the operation patterns, the basic construction of a hydraulic excavator on which the hydraulic control system of this embodiment is mounted will be first explained with reference to FIGS. 19 and 20. The hydraulic excavator comprises a lower travel body 102 including left and right crawler belts 100, 101, an upper swing 103 swingably mounted on the lower travel body 102, and a boom 104, an arm 105 and a bucket 106 which are attached to the upper swing 103 and jointly constitute a front attachment. The left and right crawler belts 100, 101, the swing 103, the boom 104, the arm 105 and the bucket 106 are respectively driven by left and right travel motors 271, 272, a swing motor 201, a boom cylinder 202, an arm cylinder 251 and a bucket cylinder 252.

[1] Operation pattern of only travel (sole)

In this operation pattern, the control levers 280*a*, 281*a* are operated to drive the travel motors 271, 272 and the operation mode signals H, I are outputted from the pressure sensors 297, 298, respectively.

(1) The pump control gains LSU and LSD are both set to a relatively small value. The operation at the start-up and slow-down of travel is thereby improved. The target differential pressure ΔPLSr is set to a medium (usual) value.

Figure 21:
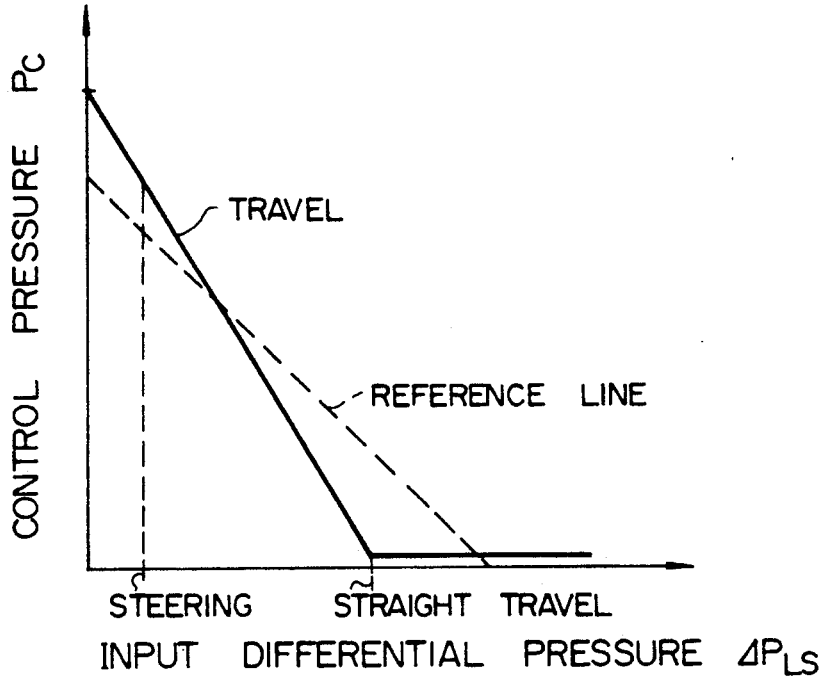
FIG. 21 is a graph showing an output pattern of the control pressure relative to the input differential pressure when the operation pattern is only travel.

(2) As shown in FIG. 21, of the variable data for the control pressure, the MIN limiter MITR is set to a small value, a MAX limiter MATR is set to a large value, and the gain GTR is set to a positive value. By so setting, the openings of the pressure compensating valves 275, 276 for travel are controlled such that they become larger than the reference during straight travel to improve the straight traveling ability, while they become smaller than the reference during steering to facilitate the steering operation.

(3) As regards to the control pressure, the rates of change KTRU in the closing direction is set to a small value and the change speed KTRD in the opening direction is set to a large value. Although the differential pressure between the pump delivery pressure and the maximum load pressure, i.e., the LS differential pressure, is transiently reduced, for example, when the speed is shifted down during straight travel or when the excavator comes into straight travel from steering condition, the pressure compensating valves 275, 276 for travel are operated slowly in the closing direction by so setting. This prevents the travel speed from changing due to abrupt effect of the pressure compensation. Also, since the pump control gain LSU is set to a small value as mentioned above, the pump delivery rate is increased moderately at this time, which also prevents the travel speed from changing due to an abrupt increase of the pump delivery rate.

[2] Operation pattern of combined travel

In this operation pattern, the control levers 280*a*, 281*a* and any of the other control levers are operated to drive the travel motors 271, 272 and the other associated actuator. The operation mode signals H, I are outputted from the pressure sensors 297, 298, respectively, and the additional operation mode signal is also outputted from the other associated pressure sensor.

(1) The pump control gains LSU and LSD are both set to a relatively small value. This prevents abrupt speed-up of travel or other operation than travel. The target differential pressure ΔPLSr is set to a medium (usual) value.

Figure 22A:
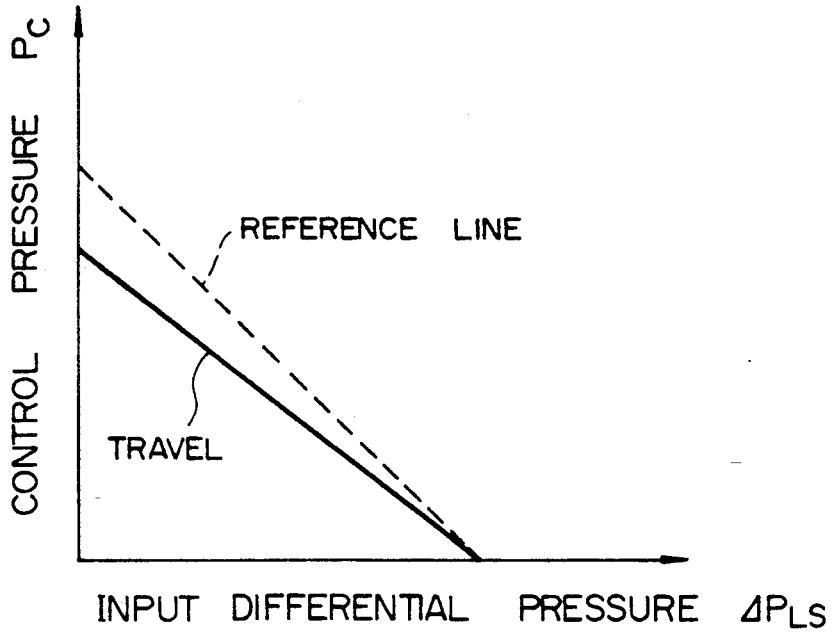
FIGS. 22(A) and 22(B) are graphs showing output patterns of the control pressure relative to the input differential pressure when the operation pattern is travel combined with other.
Figure 22B:
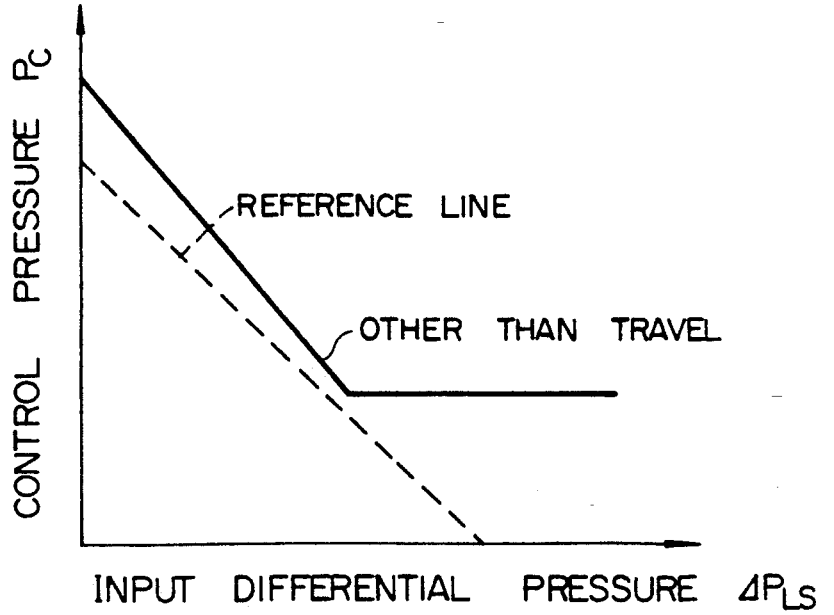

(2) As shown in FIG. 22, the gain G of the actuator for other than travel is set to a positive value and the gain GTR of the actuators for travel is set to a negative value. By so setting, the opening of the pressure compensating valve associated with the front attachment, which constitutes a working machine, is controlled to become smaller than the reference, while the openings of the pressure compensating valves 275, 276 for travel are controlled to become larger than the reference. This gives the travel operation priority over other operations in the control system. Accordingly, when the front attachment is maintained without extreme slow down operated while traveling, the travel speed is.

(3) As for the control pressure for travel, the rates of change KTRU in the closing direction and the rates of change KTRD in the opening direction are both set to a small value and, as compare with to the control pressure for operations other than the travel operation, the rates of change in the closing direction is set to a large value, while the rates of change in the opening direction is set to a small value. Although the LS differential pressure is transiently reduced when the front attachment is operated while traveling, the pressure compensating valves 275, 276 for travel are operated slowly in the closing direction by such a setting, which prevents abrupt speed-down of travel. In the case of lifting the load by the front attachment, therefore, the load is suppressed from swaying due to abrupt speed change in travel.

[3] Operation pattern of only swing (sole)

In this operation pattern, the control lever 210*a* is operated to drive the swing motor 201 and the operation mode signal A is outputted from the pressure sensor 290.

(1) The pump control gain LSU is set to a small value and the pump control gain LSD is set to a large value. This causes the delivery rate of the main pump 200 to be slowly increased at the start-up of swing, thereby preventing a burst-out, i.e., an abrupt acceleration. Also, since the swing speed can be reduced with a quick response and the delivery rate of the main pump 200 has a tendency to keep down its increase when the directional control valve is vibrated upon sway of the machine body, the operation is stabilized. The target differential pressure ΔPLSr is set to a medium (usual) value.

Figure 23:
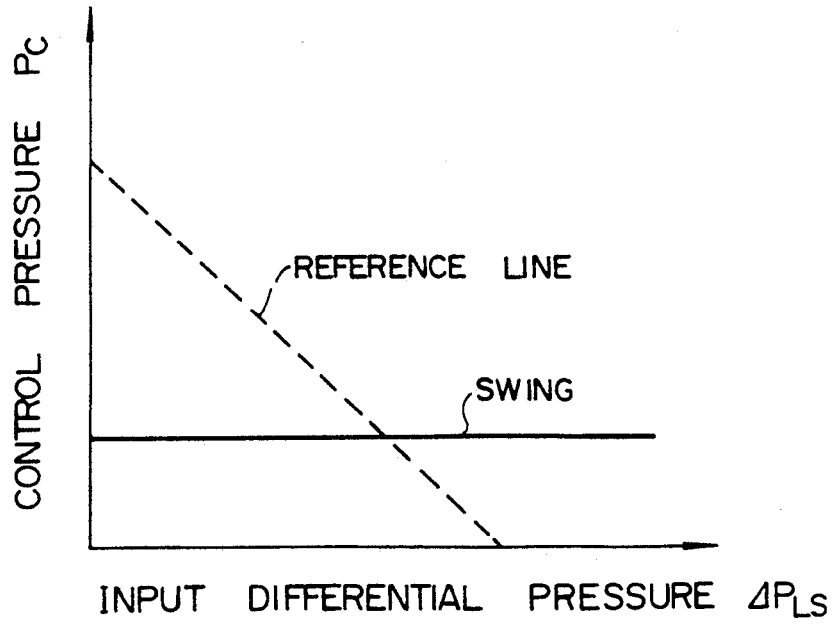
FIG. 23 is a graph showing an output pattern of the control pressure relative to the input differential pressure when the operation pattern is only swing.

(2) As shown in FIG. 23, among the variable data for the control pressure relating to swing, values of the MAX limiter MASW and the MIN limiter MISW are set to the same value. By so setting, the control pressure Pc is held constant regardless of change in the input differential pressure ΔPLS and thus so is the compensation pressure of the pressure compensating valve 205 for swing. As a result, when the compensation pressure is varied during the work of lifting the load while making a swing, the lifted load can be suppressed in its sway.

(3) In this case, since the control pressure Pc is constant, it will not be changed upon change in the LS differential pressure. As regards to the control pressure, therefore, the change speed in the closing direction and the change speed in the opening direction are not set.

[4] Operation pattern of simultaneous driving of arm pull and boom-up (typically level pulling)

In this operation pattern, the control levers 260*a*, 211*a* are operated to drive the arm cylinder 251 in the extending direction and the boom cylinder 202 in the extending direction, respectively. The operation mode signals D, B are outputted from the pressure sensors 293, 291, respectively.

(1) The pump control gain LSU is set to a large value and the pump control gain LSD is set to a small value. By so setting, the delivery rate of the main pump 200 is quickly increased to ascend the boom promptly during the level pulling, thereby preventing a drop of the bucket tip. Also, the delivery rate of the main pump 200 is slowly decreased to prevent the pawl tip from rocking unstably when the boom is descended midway the level pulling.

Figure 24:
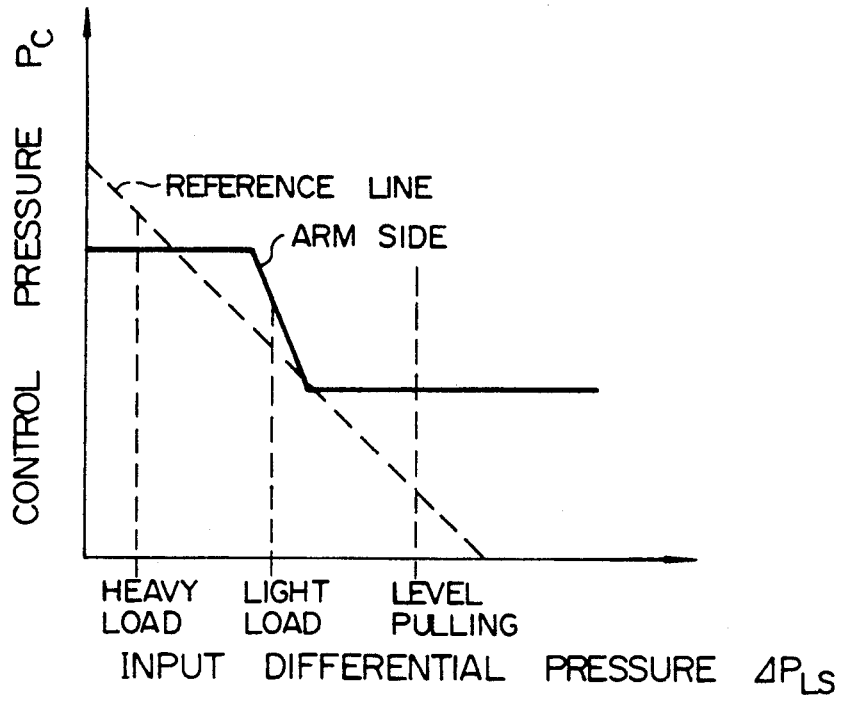
FIGS. 24(A) and 24(B) are graphs showing output patterns of the control pressure relative to the input differential pressure when the operation pattern is boom-up and arm pull.
Figure 24:
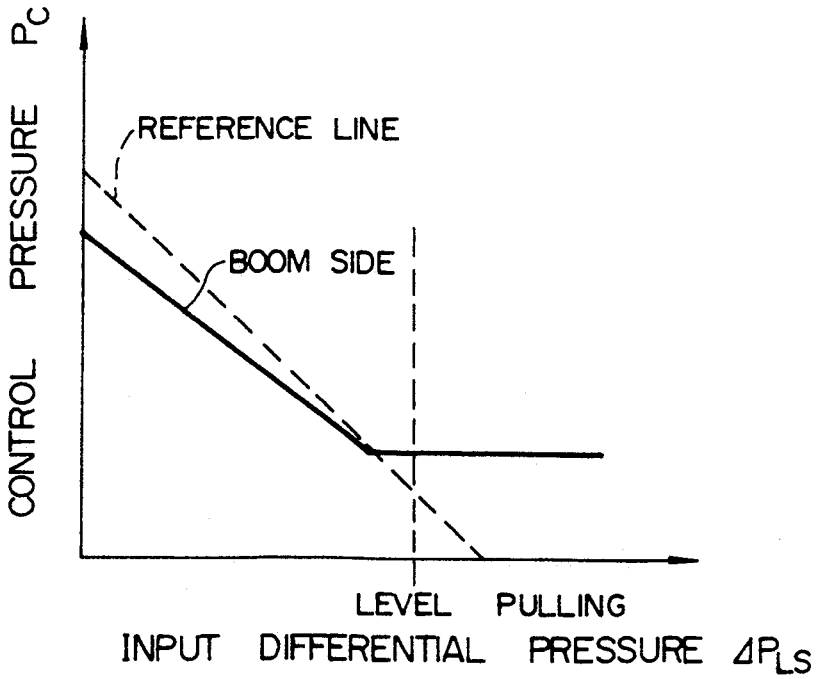

(2) As shown in FIG. 24, among the variable data for the control pressure relating to the arm, the MIN limiter MIAM is set to a large value, the MAX limiter MAAM is set to a small value, the gain GAM is set to a positive value, and the offset OAM is set to a small value. Further, among the variable data for the control pressure relating to the boom, the MIN limiter MIBM is set to a large value, the MAX limiter MABM is set to a large value, the gain GBM is set to a negative value, and the offset OBM is set to a large value. By so setting, during the level pulling, the opening of the pressure compensating valve 255 for the arm is controlled to take a fixed value smaller than the reference value, thereby preventing a drop of the bucket tip. Also, during a condition of the light load where the differential pressure ΔPLS is not so reduced, the opening of the pressure compensating valve 255 for the arm is controlled to become smaller than the reference (arm non-priority control), thereby promoting an ascend of the boom. Further, during a condition of heavy digging where the differential pressure ΔPLS is extremely reduced, the opening of the pressure compensating valve 255 for the arm is controlled to become larger than the reference for preferentially supplying the hydraulic fluid to the arm cylinder 251. As a result, the working efficiency can be improved. In addition, since the opening of the pressure compensating valve 206 for the boom is controlled to take a fixed value smaller than the reference during the level pulling, the boom is preventing from rocking unstably in the boom-up operation. During the condition of light load and heavy load, since the opening of the pressure compensating valve 206 for the boom is controlled to become larger than the reference, the hydraulic fluid is sufficiently supplied to the boom cylinder 202 so that the boom is similarly prevented from rocking unstably in the boom-up operation.

(3) The target differential pressure ΔPLSr set in the target differential pressure block 303 is set to a relatively large value. This enables an operator to pull the boom up at the time when the operation is shifted from the level pulling, primarily consisted of arm pull, to boom-up.

(4) As regards to the control pressure for the arm, the change speed KAMU in the closing direction is set to a large value and the rates of change KAMD in the opening direction is set to a small value. As regards to the control pressure for the boom, the rates of change KBMU in the closing direction is set to a small value and the rates of change KBMD in the opening direction is also set to a small value. By so setting, when the LS differential pressure ΔPLS is abruptly reduced at start-up of the level pulling work, the pressure compensating valve 255 for the arm is quickly throttled to prevent a drop of the arm. Also, when the LS differential pressure ΔPLS is abruptly increased upon the boom-up speed being abruptly slowed down, by way of example, the speed of the pressure compensating valve 255 for the arm in the opening direction is so small that the arm operation can be prevented from speeding up abruptly. Further, since the speeds of the pressure compensating valve 206 for the boom in the opening and closing directions are both small, it is possible to positively lift the boom and also prevent the boom from rocking unstably in the boom-up operation.

With this embodiment, because the pump control signal calculating function 300 for the above (1), (3) and the valve control signal calculating function 301 for the above (2), (4) are simultaneously effected to calculate and output the control signals during the level pulling, more preferable operability can be secured from the combined effect of both the functions.

[5] Operation pattern of boom-up alone

In this operation pattern, the control lever 211*a* is operated to drive the boom cylinder 202 in the extending direction and the operation mode signal B is outputted from the pressure sensor 291.

(1) The pump control gain LSU is set to a medium value and the pump control gain LSD is set to a small value. In this way the occurrence of a shock at the startup of boom-up is prevented and also an abrupt slow down of the boom-up operation is avoided when the control lever is returned, thereby alleviating a shock. The target differential pressure ΔPLSr is set to a medium (usual) value.

Figure 25:
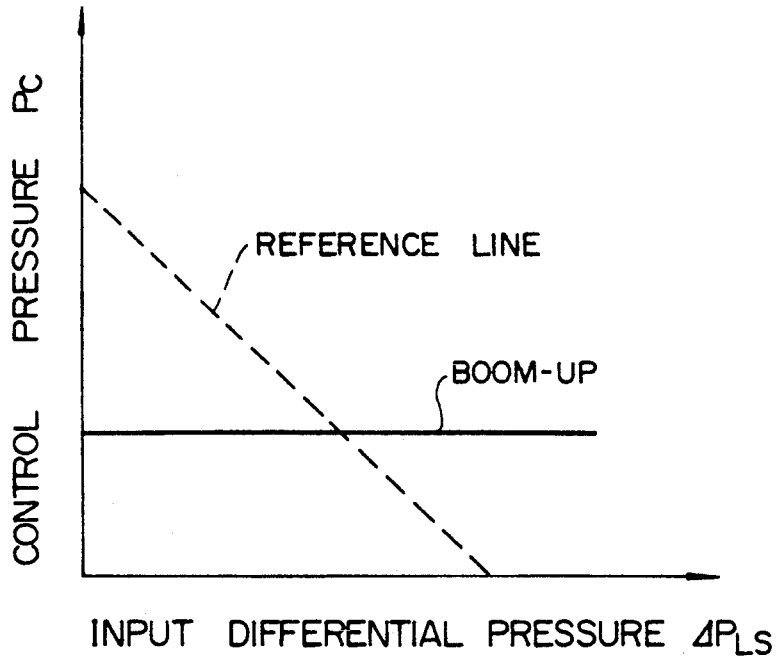
FIG. 25 is a graph showing an output pattern of the control pressure relative to the input differential pressure when the operation pattern is only boom-up.

(2) As shown in FIG. 25, among the variable data for the control pressure relating to boom-up, values of the MAX limiter MABM and the MIN limiter MIBM are set to the same value. By so setting, the control pressure Pc is held constant regardless of change in the input differential pressure ΔPLS and thus so is the compensation pressure of the pressure compensating valve 206 for the boom. As a result, the boom speed corresponding to the lever operation can be achieved to improve metering.

(3) In this case, since the control pressure Pc is constant, it will not be changed upon change in the LS differential pressure. As regards to the control pressure, therefore, the rates of change in the closing direction and the rates of change in the opening direction are not set.

[6] Operation pattern including swing and arm pull

In this operation pattern, at least the control levers 210*a*, 260*a* are operated to drive the swing motor 201 and the arm cylinder 251 in the extending direction, and the operation mode signals A, D are outputted from the pressure sensors 290, 293, respectively. This operation pattern also includes the cases of actuating any other working member during the combined operation of swing and arm pull simultaneously, for example, such patterns as swing+arm pull+bucket pull and swing+arm pull+bucket pull+boom-up.

(1) The pump control gains LSU and LSD are both set to a medium value. This improves the basic combined operability. The target differential pressure ΔPLSr is set to a medium (usual) value.

Figure 26A:
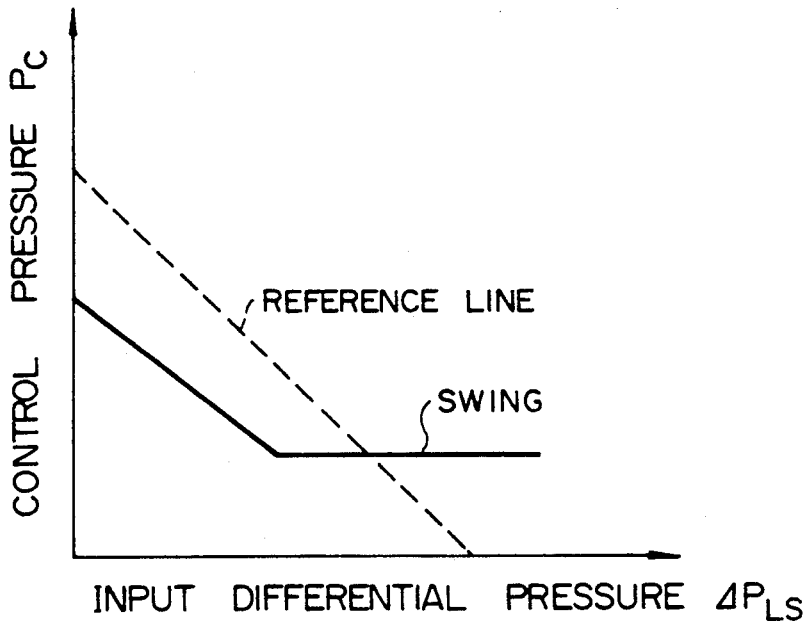
FIGS. 26(A) and 26(B) are graphs showing output patterns of the control pressure relative to the input differential pressure when the operation pattern is combined operation including swing and arm pull.
Figure 26B:
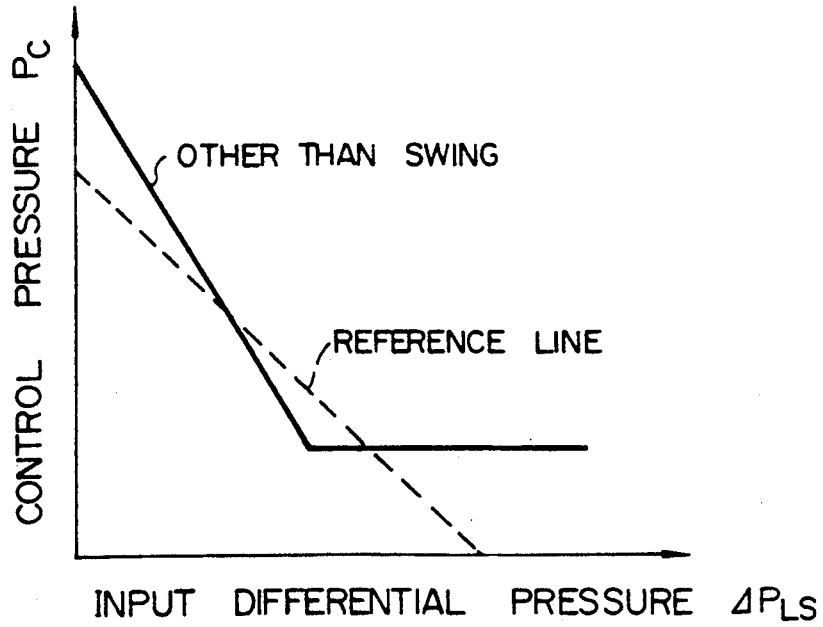

(2) As shown in FIG. 26, among the variable data for the control pressure relating to swing, the MIN limiter MISW is set to a large value, the MAX limiter MASW is set to a large value, the gain GSW is set to a negative value, and the offset OSW is set to a large value. Further, among the variable data for the control pressure relating to other than swing, the MIN limiter MISW is set to a large value, the MAX limiter MASW is set to a large value, the gain GSW is set to a positive value, and the offset OSW is set to a small value. By so setting, the opening of the pressure compensating valve 205 for swing is controlled to become larger than the reference and the opening of the pressure compensating valve for other than swing is controlled to become smaller than the reference, thereby preferentially supplying the hydraulic fluid to the swing motor 201. As a result, the swing pressure can be increased to prevent the swing from getting away when digging is made by pressing of the swing.

(4) As regards to the control pressure for swing, the rates of change KSWU in the closing direction is set to a small value and the rates of change KSWD in the opening direction is set to a large value. As regards to the control pressure for other than swing, the rates of change in the closing direction is set to a large value and the rates of change in the opening direction is set to a small value. By so setting, when the LS differential pressure ΔPLS is abruptly reduced by starting up the swing operation from the arm-pull operation, by way of example, the speed of the pressure compensating valve 205 for swing in the closing direction is small and the speed of the pressure compensating valve 255 for the arm in the closing direction is large, making it possible to promptly hold the swing pressure. Further, when the load for pulling the arm is lessened and the LS differential pressure ΔPLS is abruptly increased during the combined operation of swing and arm pull, the speed of the pressure compensating valve 255 for the arm in the opening direction is so small that the arm operation can be prevented from speeding up abruptly.

Finally, several modifications of the above embodiment will be described below.

Figure 27:
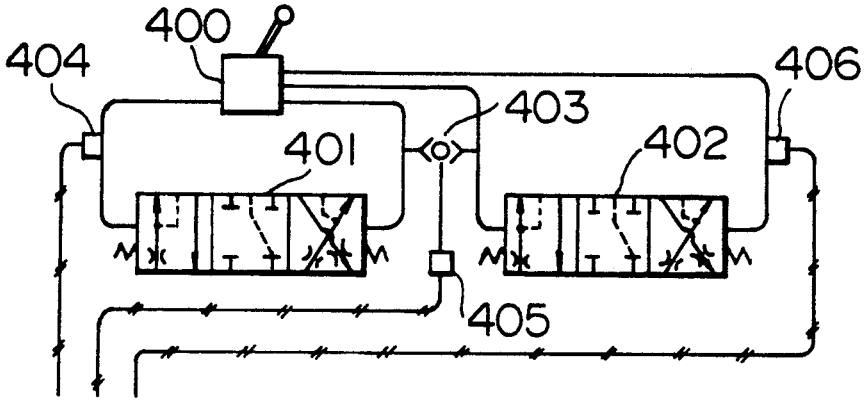
FIGS. 27 to 29 are diagrams showing other embodiments of operation signal detecting means.

The pressure sensors specific to the respective actuators are used as the operation signal detecting means in the above embodiment, part of the pressure sensors may be shared. FIG. 27 shows a modification to implement that purpose. In this modification, of pilot lines coupling a control lever unit 400 with two directional control valves 401 and 402, there is connected a shuttle valve 403 between the two pilot lines respectively associated with the two directional control valves 401 and 402. A signal pressure taken out by the shuttle valve 403 is introduced to a pressure sensor 405 which selectively detects driving of the directional control valve 401, 402 and outputs the detected result as an operation signal. Pressure sensors 404, 406 are respectively disposed in the other two pilot lines to separately detect driving of the directional control valves 401, 402 in the opposite directions and output the detected results as operation signals.

Figure 28:
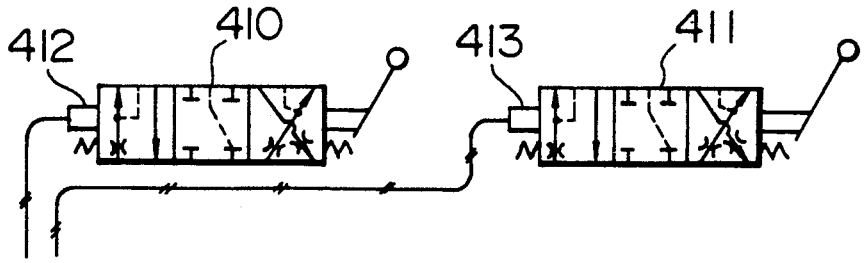
Figure 29:
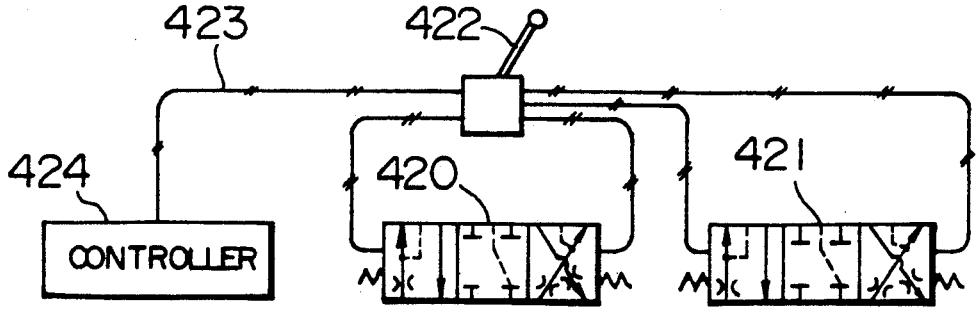

In the above embodiment, the pressure sensors are used as the operation signal detecting means. Instead of the pressure sensors, however, position sensors 412, 413 for detecting spool strokes of the directional control valves 410, 411 may be provided as shown in FIG. 28.

Further, although the above embodiment is arranged such that the directional control valves 203, 204, etc. are driven by the pilot pressure, the present invention may be arranged such that the directional control valves 420, 421 may be driven by electric signals outputted from an electric lever 422. In this case, installation of the operation signal detecting means may be dispensed with. Thus, the electric signals outputted from the electric lever 42 are directly applied via a signal line 423 to a controller 424 which identifies the operation pattern of the associated actuator directly from those electric signals.

INDUSTRIAL APPLICABILITY

With the thus-arranged hydraulic control system for construction machines according to the present invention, since the flow rates of the hydraulic fluid supplied to various actuators are appropriately controlled when the LS differential pressure for load sensing control is changed, the excellent operability undergoing less shocks can be realized.

We claim:

1. A hydraulic control system for a construction machine comprising a hydraulic pump of variable displacement type, a plurality of actuators driven by a hydraulic fluid supplied from said hydraulic pump, a plurality of valve means connected between said hydraulic pump and said actuators, and pump control means for controlling a displacement volume of said hydraulic pump so that a delivery pressure of said hydraulic pump is held higher by a predetermined value than a maximum load pressure among said plurality of actuators, said plurality of valve means respectively having variable throttles with openings that are varied in accordance with operation signals received from operation means for controlling flow rates of the hydraulic fluid supplied to the associated actuators, and auxiliary valves arranged in series with said variable throttles for additionally controlling the flow rates of hydraulic fluid supplied to the associated actuators, wherein:

said hydraulic control system further comprises:

(A) first detection means for detecting a differential pressure between the delivery pressure of said hydraulic pump and said maximum load pressure and for outputting a corresponding differential pressure signal;

(B) second detection means for detecting an operation pattern of said plurality of actuators and for outputting a corresponding operation pattern signal; and (C) valve control means for calculating valve control signals based on the differential pressure signal and the operation pattern signal outputted from said first and second detection means, respectively, for controlling driving of said auxiliary valves to control the flow rates of hydraulic fluid supplied to the associated actuators;

said valve control means including:

(a) first means for storing plural output patterns of an auxiliary valve control amount as a function of said differential pressure signal in relation to a plurality of the operation pattern signals and, when said operation pattern signal is outputted from said second detection means, for selecting one of the output patterns corresponding to the operation pattern signal outputted, followed by calculating an auxiliary valve control amount dependent upon said differential pressure signal outputted from said first detection means based on the selected output pattern;

(b) second means for storing plural sets of rates of change for said auxiliary valve control amount in relation to a plurality of the operation pattern signals and, when said operation pattern signal is outputted from said second detection means, for selecting one of the sets of the rates of change corresponding to the operation pattern signal outputted; and (c) third means for combining the auxiliary valve control amount calculated by said first means with the set of rates of change selected by said second means to calculate each said valve control signal.

2. A hydraulic control system for a construction machine according to claim 1, wherein said first means has:

(1) means for storing a reference pattern of said auxiliary valve control amount as a function of said differential pressure signal;

(2) means for storing plural sets of variable data for said reference pattern in relation to said plurality of operation pattern signals and, when said operation pattern signal is outputted from said second detection means, for selecting one of the sets of variable data corresponding to the operation pattern signal outputted; and (3) means for combining said reference pattern with said selected set of variable data to obtain said output pattern, and calculating the auxiliary valve control amount dependent upon said differential pressure signal based on said output pattern.

3. A hydraulic control system for a construction machine according to claim 2, wherein said plural sets of variable data for said reference pattern each include respective values of a gain for changing a gradient of said reference pattern, an offset for translating said reference pattern, a maximum limiter for limiting a maximum value of said reference pattern, and a minimum limiter for limiting a minimum value of said reference pattern.

4. A hydraulic control system for a construction machine according to claim 1, wherein said plural sets of rates of change stored in said second means each include respective values of a rates of change in the closing direction and a rates of change in the opening direction for each of said auxiliary valves.

5. A hydraulic control system for a construction machine according to claim 4, wherein said third means determines that the value of said auxiliary valve control amount calculated by said first means is to operate each of said auxiliary valves in a corresponding one of the closing direction and the opening direction, selects one of said rates of change in the closing direction and one of said rates of change in the opening direction dependent upon the decision result, and combines said selected rates of change with the auxiliary valve control amount calculated by said first means for calculating each of said valve control signals.

6. A hydraulic control system for a construction machine according to claim 1, wherein said pump control means includes:

(d) fourth means for storing plural sets of control gains for said hydraulic pump in relation to plural operation pattern signals and, when said operation pattern signal is outputted from said second detection means for selecting one set of control gains corresponding to the operation pattern signal outputted; and (e) fifth means for determining a deviation between said differential pressure signal outputted from said first detection means and a preset target differential pressure, calculating pump control signals to reduce said differential pressure deviation using both said differential pressure deviation and the set of control gains selected by said fourth means and controlling the displacement volume of said hydraulic pump based on said pump control signals.

7. A hydraulic control system for a construction machine according to claim 6, wherein said plural sets of control gains stored in said fourth means each include respective values of an increase gain which are predetermined for control in the increasing direction of the displacement volume of said hydraulic pump and a decrease gain which are predetermined for control in the decreasing direction of the displacement volume of said hydraulic pump.

8. A hydraulic control system for a construction machine according to claim 7, wherein said fifth means determines that the value of said differential pressure deviation is to control the displacement volume of said hydraulic pump in which one of the increasing direction and the decreasing direction, selects one of said increase gain and decrease gain dependent upon the decision result, and calculates said pump control signals using both said selected gain and said differential pressure deviation.

9. A hydraulic control system for a construction machine according to claim 6, wherein said pump control means further includes:

(f) sixth means for storing a plurality of target differential pressures between the delivery pressure of said hydraulic pump and said maximum load pressure in relation to plural operation pattern signals and, when said operation pattern signal is outputted from said second detection means for selecting one of said target differential pressures corresponding to the operation pattern signal outputted;

and wherein said fifth means uses the target differential pressure selected by said sixth means as said preset target differential pressure.

10. A hydraulic control system for a construction machine according to claim 1, wherein said second detection means includes operation signal detecting means for detecting the respective operation signals outputted from said operation means and outputting the corresponding operation mode signals.

11. A hydraulic control system for a construction machine comprising a hydraulic pump of variable displacement type, a plurality of actuators driven by a hydraulic fluid supplied from said hydraulic pump, a plurality of valve means connected between said hydraulic pump and said actuators, and pump control means for controlling a displacement volume of said hydraulic pump so that a delivery pressure of said hydraulic pump is held higher a predetermined value than a maximum load pressure among said plurality of actuators, said plurality of valve means respectively having variable throttles of which openings are varied dependent upon operation signals from operation means to control flow rates of the hydraulic fluid supplied to the associated actuators, and auxiliary valves arranged in series with said variable throttles for additionally controlling the flow rates of the hydraulic fluid supplied to the associated actuators, wherein:

said hydraulic control system further comprises:

(A) first detection means for detecting a differential pressure between the delivery pressure of said hydraulic pump and said maximum load pressure and outputting a corresponding differential pressure signal; and (B) second detection means for detecting an operation pattern of said plurality of actuators and outputting a corresponding operation pattern signal, said pump control means including:

(a) first means for storing plural sets of control gains (LSD, LSU) for said hydraulic pump in relation to plural operation pattern signals and, when said operation pattern signal is outputted from said second detection means for selecting one set of control gains corresponding to the operation pattern signal outputted; and (b) second means for determining a deviation between said differential pressure signal outputted from said first detection means and a preset target differential pressure, calculating pump control signals to reduce said differential pressure deviation using both said differential pressure deviation and the set of control gains selected by said first means and controlling the displacement volume of said hydraulic pump based on said pump control signals.

12. A hydraulic control system for a construction machine according to claim 11, wherein said plural sets of control gains stored in said first means each include respective values of an increase gain suited for control in the increasing direction of the displacement volume of said hydraulic pump and a decrease gain suited for control in the decreasing direction of the displacement volume of said hydraulic pump.

13. A hydraulic control system for a construction machine according to claim 12, wherein said second means determines that the value of said differential pressure deviation is to control the displacement volume of said hydraulic pump in which one of the increasing direction and the decreasing direction, selects one of said increase gain and decrease gain dependent upon the decision result, and calculated said pump control signals using both said selected gain and said differential pressure deviation.

14. A hydraulic control system for a construction machine according to claim 11, wherein said pump control means further includes;

(c) third means for storing a plurality of target differential pressures between the delivery pressure of said hydraulic pump and said maximum load pressure in relation to plural operation pattern signals and, when said operation pattern signal is outputted from said second detection means, for selecting one of said target differential pressures corresponding to the operation pattern signal outputted;

and wherein said second means uses the target differential pressure selected by said third means as said preset target differential pressure.

* * * * *